US010801201B2

(12) United States Patent
Pfeffer et al.

(10) Patent No.: US 10,801,201 B2
(45) Date of Patent: Oct. 13, 2020

(54) CONCRETE CEILING, KIT FOR PRODUCING A CONCRETE CEILING, AND METHOD FOR PRODUCING A CONCRETE CEILING

(71) Applicant: Heinze Gruppe Verwaltungs GmbH, Herford (DE)

(72) Inventors: Karsten Pfeffer, Wiesbaden (DE); Volkmar Wanninger, Eltville-Hattenheim (DE)

(73) Assignee: Heinze Gruppe Verwaltungs GmbH, Herford (DE)

( * ) Notice: Subject to any disclaimer, the term of this patent is extended or adjusted under 35 U.S.C. 154(b) by 0 days.

(21) Appl. No.: 16/337,013

(22) PCT Filed: Sep. 27, 2017

(86) PCT No.: PCT/EP2017/074542
§ 371 (c)(1),
(2) Date: Mar. 27, 2019

(87) PCT Pub. No.: WO2018/060279
PCT Pub. Date: Apr. 5, 2018

(65) Prior Publication Data

US 2019/0249426 A1 Aug. 15, 2019

(30) Foreign Application Priority Data

Sep. 28, 2016 (DE) ..... 10 2016 118 298

(51) Int. Cl.
*E04B 9/06* (2006.01)
*E04B 5/32* (2006.01)

(52) U.S. Cl.
CPC ..... *E04B 9/06* (2013.01); *E04B 5/326* (2013.01); *E04B 2103/02* (2013.01)

(58) Field of Classification Search
CPC ..... E04B 9/06; E04B 5/326; E04B 2103/02
See application file for complete search history.

(56) References Cited

U.S. PATENT DOCUMENTS

| | | | |
|---|---|---|---|
| 6,789,366 | B1 | 9/2004 | Febra |
| 2013/0036693 | A1 | 2/2013 | Lee et al. |

FOREIGN PATENT DOCUMENTS

| | | | |
|---|---|---|---|
| BR | MU8701789 | U2 | 7/2009 |
| CL | 55937 | | 4/2015 |
| CN | 101413313 | A | 4/2009 |
| CN | 101906874 | A | 12/2010 |
| CN | 102094520 | A | 6/2011 |

(Continued)

OTHER PUBLICATIONS

International Search Report of PCT/EP2017/074542, dated Dec. 13, 2017.

(Continued)

*Primary Examiner* — Patrick J Maestri
(74) *Attorney, Agent, or Firm* — Collard & Roe, P.C.

(57) ABSTRACT

A concrete ceiling has a lower reinforcing mesh and an upper reinforcing mesh between which a plurality of displacement bodies are arranged, wherein the lower and upper reinforcing mesh and the displacement bodies are embedded in concrete and each displacement body at least partially surrounds at least one channel which establishes a connection between the concrete at the lower reinforcing mesh and the concrete at the upper reinforcing mesh.

13 Claims, 37 Drawing Sheets

(56) References Cited

FOREIGN PATENT DOCUMENTS

| | | | |
|---|---|---|---|
| DE | 202006002540 | U1 | 8/2006 |
| KR | 1020110119345 | A | 11/2011 |
| KR | 20150018149 | A | 2/2015 |
| WO | 0103898 | A1 | 1/2001 |
| WO | 2015182817 | A1 | 12/2015 |
| WO | 2015182818 | A1 | 12/2015 |

OTHER PUBLICATIONS

Chilean Office Action dated Mar. 5, 2020 issued in the corresponding Chilean Application No. 789-2019 (with English translation of relevant parts).

CONCRETE CEILING, KIT FOR PRODUCING A CONCRETE CEILING, AND METHOD FOR PRODUCING A CONCRETE CEILING

CROSS REFERENCE TO RELATED APPLICATIONS

This application is the National Stage of PCT/EP2017/074542 filed on Sep. 27, 2017, which claims priority under 35 U.S.C. § 119 of German Application No. 10 2016 118 298.2 filed on Sep. 28, 2016, the disclosures of which are incorporated by reference. The international application under PCT article 21(2) was not published in English.

BACKGROUND OF THE INVENTION

The present invention relates to a concrete ceiling having a lower reinforcing mesh and an upper reinforcing mesh between which a plurality of displacement bodies are arranged, wherein the lower and upper reinforcing mesh and the displacement bodies are embedded in concrete and each displacement body at least partially surrounds at least one channel which establishes a connection between the concrete at the lower reinforcing mesh and the concrete at the upper reinforcing mesh, a kit for producing a concrete ceiling and a method for producing a concrete ceiling.

DE 20 2006 002 540 U1 discloses a module for the production of concrete parts in which a large number of spherical displacement bodies are captively arranged in a latticework of bars. As a result, the spherical displacement bodies can reduce the weight of the ceiling structure during the subsequent pouring of concrete. The insertion of the displacement bodies into the latticework and the production of such a latticework are comparatively complex. In addition, the distance between the displacement bodies can vary, making it difficult to calculate the load-bearing capacity.

US 2013/0036693 discloses a donut-shaped displacement body having a channel in the middle that is filled with concrete during pouring. This creates a connection between the underside and the top of a concrete ceiling. However, the displacement bodies are arranged spaced apart from each other so that struts are also provided between the displacement bodies to connect the underside with the top. In order to provide a defined distance between the displacement bodies, reinforcement elements must be installed which are connected to the displacement bodies. The installation of such reinforcing meshes for spacing the displacement bodies is comparatively complex.

SUMMARY OF THE INVENTION

It is therefore the object of the present invention to create a concrete ceiling, a construction kit for the production of a concrete ceiling and a method for the production of a concrete ceiling, which allow a simple production of the concrete ceiling and a comparatively accurate calculation of the load-bearing capacity of the concrete ceiling.

This object is solved by a concrete ceiling with the features of claim 1, a kit with the features of claim 10 and a method for producing a concrete ceiling with the features of claim 11.

In the case of the concrete ceiling in accordance with the invention, a large number of displacement bodies are arranged between an upper and a lower reinforcing mesh, wherein the displacement bodies abut each other on at least three sides in at least some areas in a central region of the concrete ceiling. This ensures that the displacement bodies are positioned immediately adjacent to each other during assembly and there is no need to provide additional positioning means between the displacement bodies. The connection between the concrete in the area of the lower reinforcing mesh and the concrete in the area of the upper reinforcing mesh is made at least via the channel formed on or in each displacement body. The channel can be completely surrounded by a single displacement body or by several displacement bodies, wherein in this case, each displacement body forms part of a channel wall. Since the size of the channel is specified in the displacement body or bodies, it is possible to determine comparatively precisely how many struts run from bottom to top in the area of the displacement bodies and what their geometry is. This means that the load-bearing capacity of the concrete ceiling can be determined comparatively precisely in advance.

Preferably no additional spacer is provided between adjacent displacement bodies so that the positioning of adjacent displacement bodies is effected by a side edge or a side wall at which the adjacent displacement bodies touch one another. In the central region of the concrete ceiling, the displacement bodies can be supported on all their sides in a circumferential manner, at least in certain areas, wherein three, four or more contact surfaces can be provided, depending on the shape of the displacement bodies.

In a preferred configuration, the ratio of the cross-section of the channel in the displacement body to the surface area of the displacement bodies in plan view is at least 0.1, preferably between 0.2 and 0.45, in particular between 0.3 and 0.4. The surface area of the channel is thus comparatively large in relation to the total surface area of the displacement body in plan view, wherein it is ensured that the channels are also filled when concrete is poured. This allows the load-bearing capacity to be calculated on the basis of the area of the channels. The channels can be circular, square, diamond-shaped or have a different geometry in plan view. Preferably, each channel has a narrowest point, which is provided in a central region of the displacement body. For example, the diameter of a channel in a displacement body can range from 200 mm to 450 mm, especially 250 mm to 400 mm. If the channel has a geometry different from the circular shape, this geometry can be converted to the above diameter range if the area of the channel corresponds to the area of a calculated diameter.

Preferably the displacement bodies are placed loosely on the lower reinforcing mesh. This simplifies assembly.

The displacement bodies are preferably square in plan view so that the area of a ceiling in which the displacement bodies are to be arranged can easily be covered with the displacement bodies.

In a further embodiment, free spaces are provided between adjacent displacement bodies, wherein in plan view the area of the free spaces is smaller than the area of the channels. Such free spaces may exist, for example, in the corner area between adjacent displacement bodies if they have rounded or beveled corners, so that smaller free spaces or channels are also formed there, which allow the concrete to be connected in the vertical direction. Alternatively, the free spaces can also be designed as channels formed between two or more displacement bodies.

A displacement body preferably comprises several hollow bodies which are connected to each other by spacers. For example, four hollow bodies can be provided, which are connected to each other via separable webs, so that the displacement body can be separated in the area of the webs if required, and, depending on the installation space of the concrete ceiling, the displacement body can also be halved to fill a concrete ceiling. The individual hollow bodies can be formed in an essentially closed manner so that no concrete flows into the hollow bodies when the spacers or webs are cut through.

In the case of the concrete ceiling according to the invention, the reinforcing meshes are essentially flat. The reinforcing meshes therefore preferably do not extend into the plane of the displacement body and can be formed from struts running at an angle, preferably at right angles to each other.

In the method for producing a concrete ceiling according to the invention, a lower reinforcing mesh is first positioned on which a plurality of displacement bodies are then placed, wherein the displacement bodies abut one another on at least three sides at least in sections in a central region of the reinforcing mesh in order to position one another. After depositing the displacement bodies, an upper reinforcing mesh is placed on the numerous displacement bodies and a concrete ceiling is produced by pouring concrete once or several times. Due to the loose positioning of the displacement bodies, there is no need to provide a predetermined distance between the displacement bodies, e.g. via reinforcement cages or special spacers. This simplifies assembly as the displacement bodies can be positioned directly adjacent to each other. With the exception of the displacement bodies arranged at the edge, the same displacement bodies are preferably supported or positioned in the middle area on all sides by adjacent displacement bodies, especially without additional spacers.

The displacement bodies can be square or rectangular in plan view and lie against each other on four sides in a central region. The displacement bodies are thus structure providers for a ceiling, wherein the channel within a displacement body preferably determines the geometry of a strut between the underside and the top of a displacement body, which enables a comparatively accurate calculation of the load-bearing capacity of the concrete ceiling.

BRIEF DESCRIPTION OF THE DRAWING FIGURES

The invention is explained in more detail below using several embodiment examples with reference to the attached drawings, wherein.

Figure 25B:
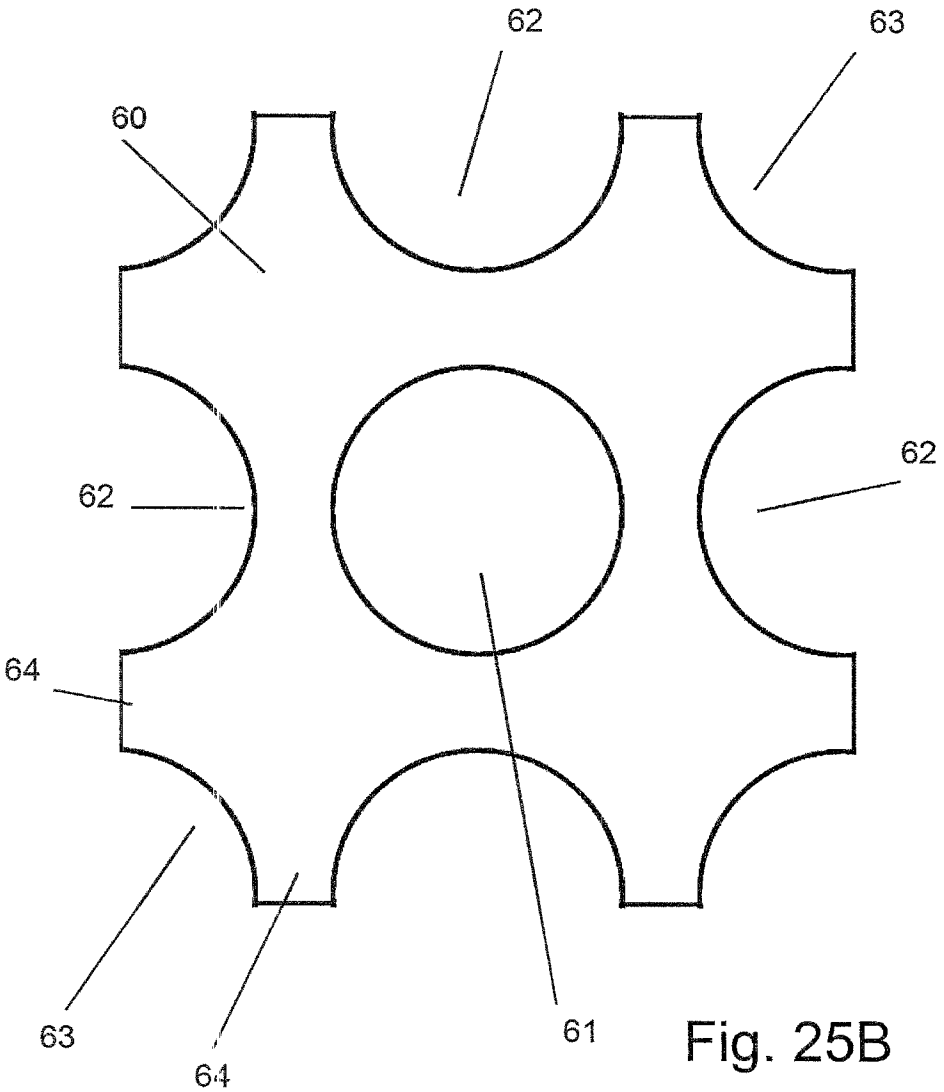
Figure 25A:
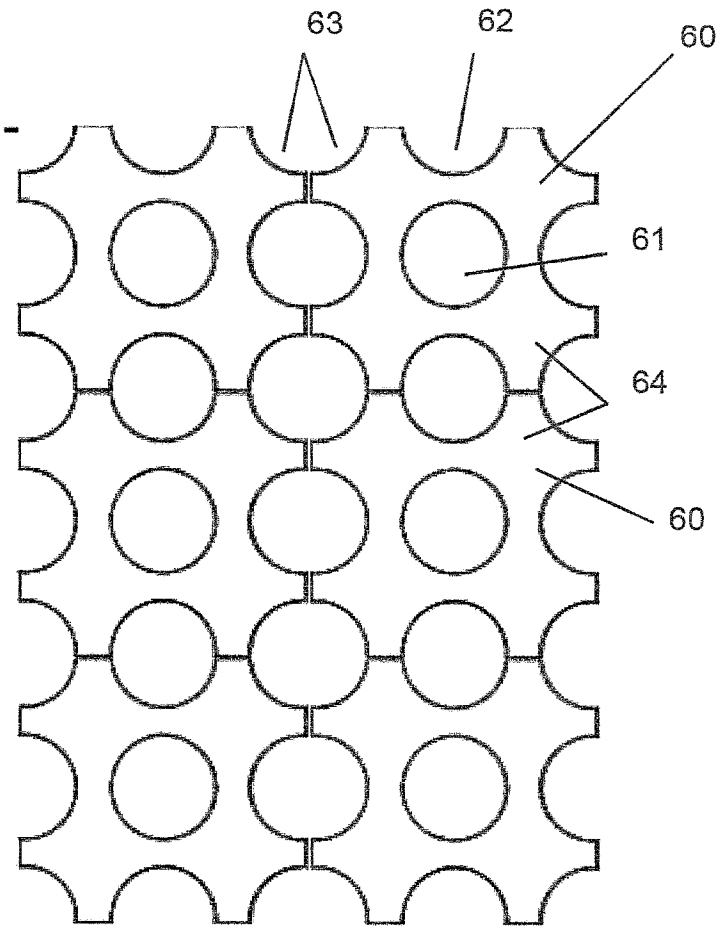
Figure 26:
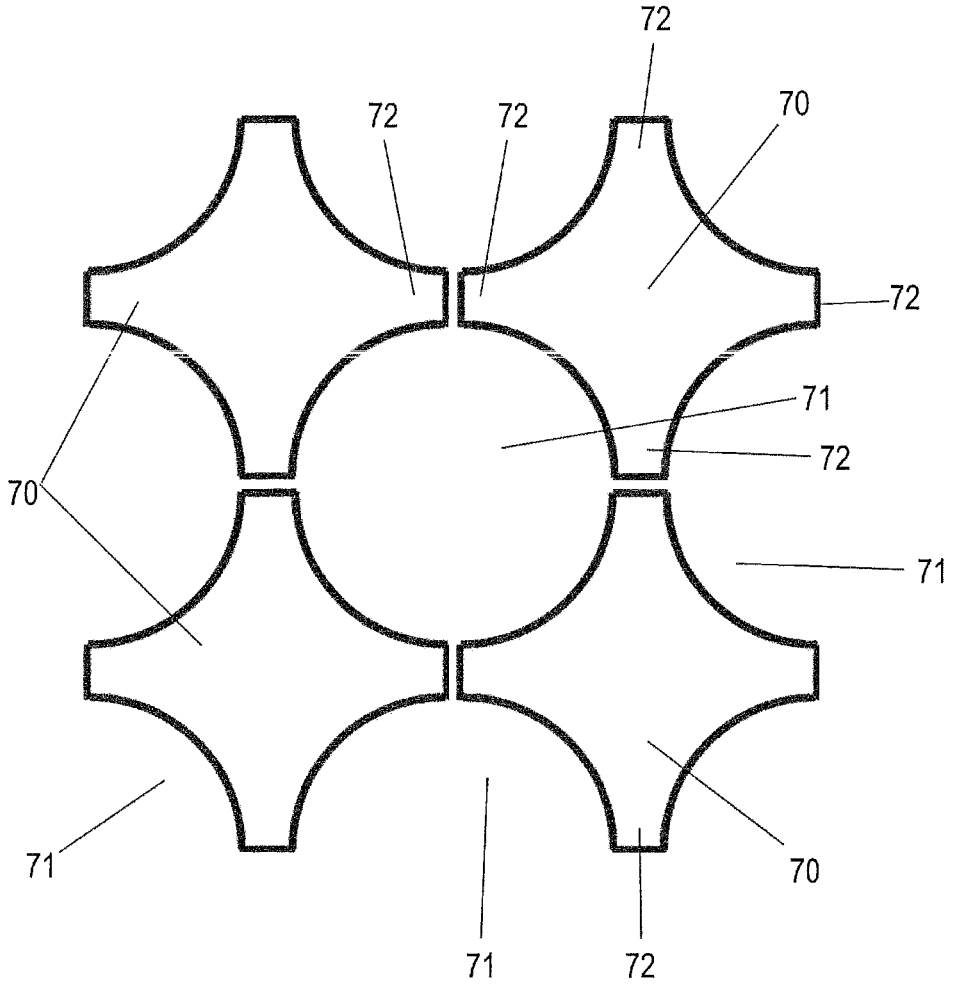
Figure 27:
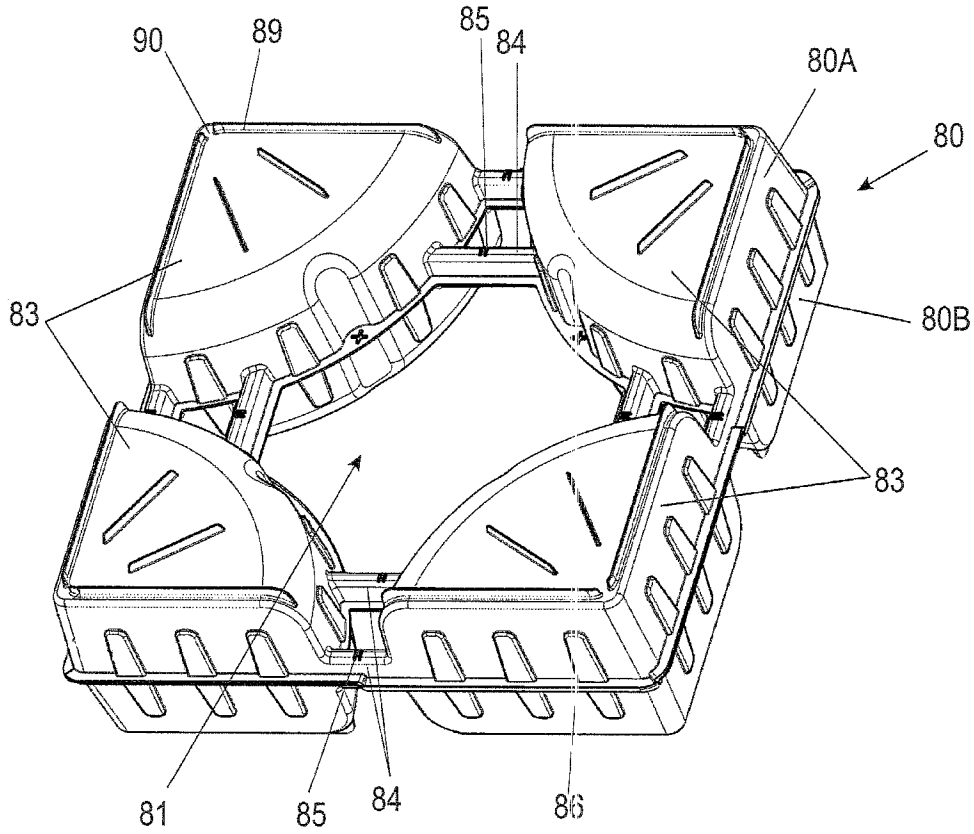
Figure 31:
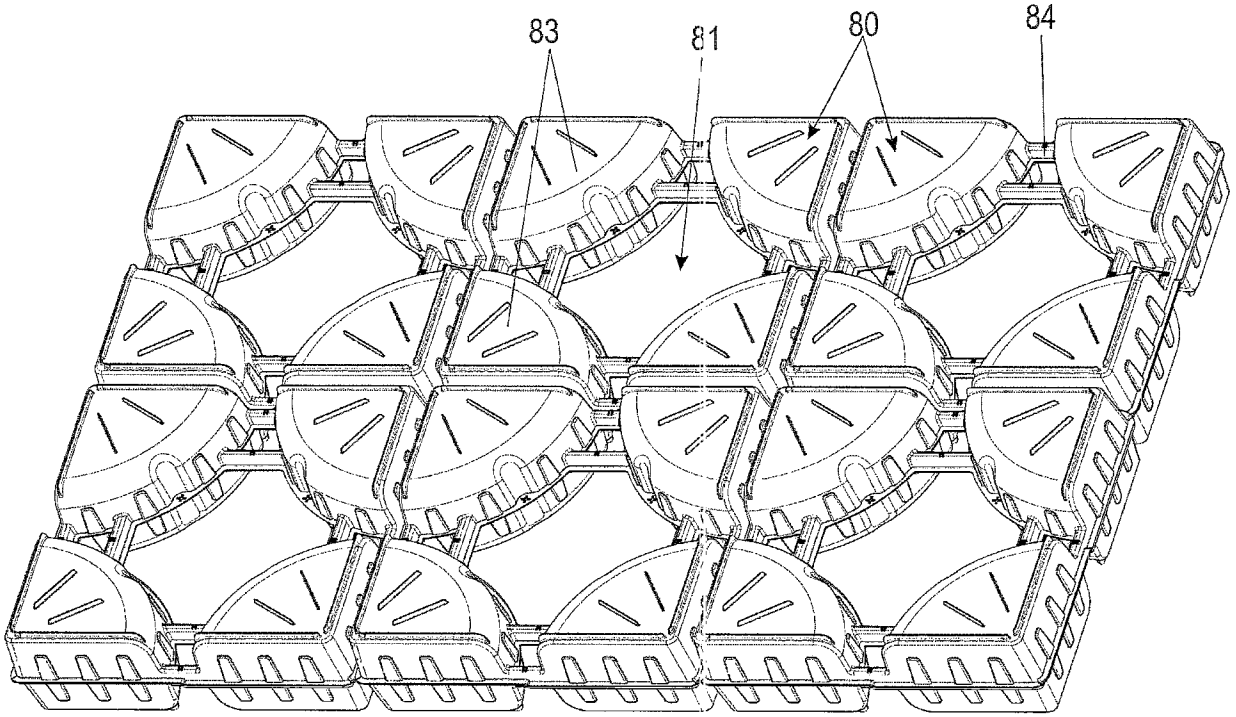
Figure 32:
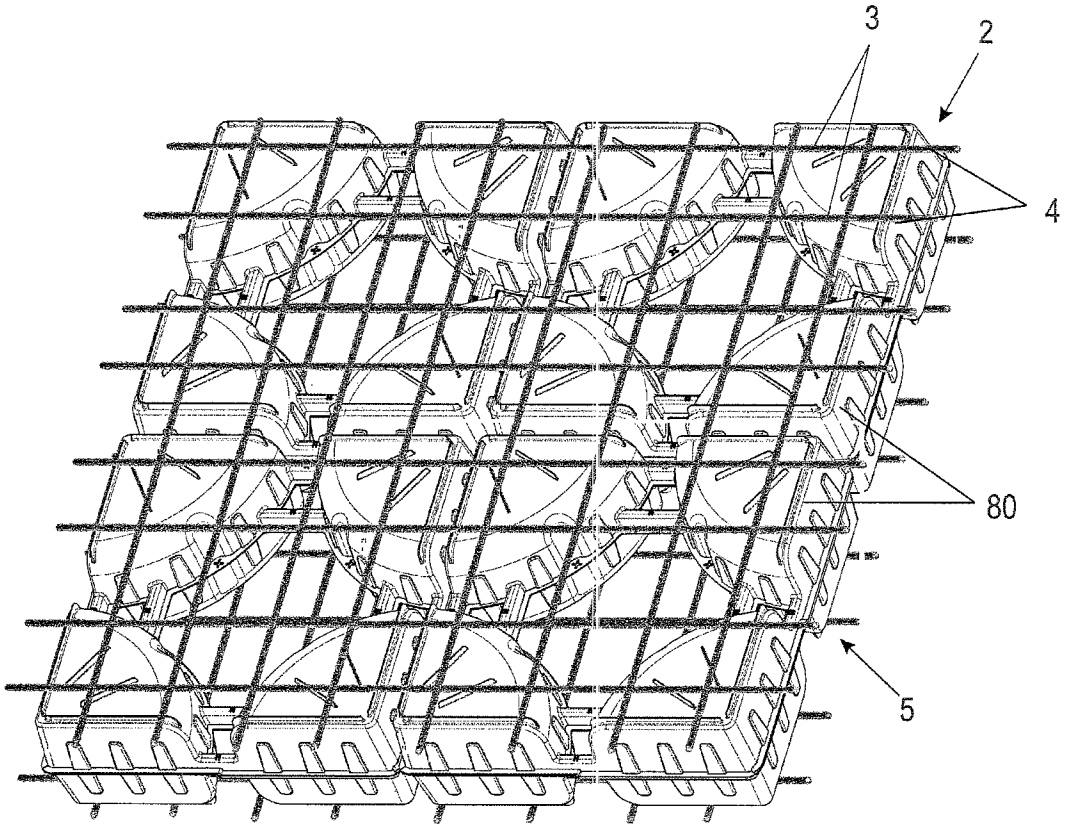
Figure 33:
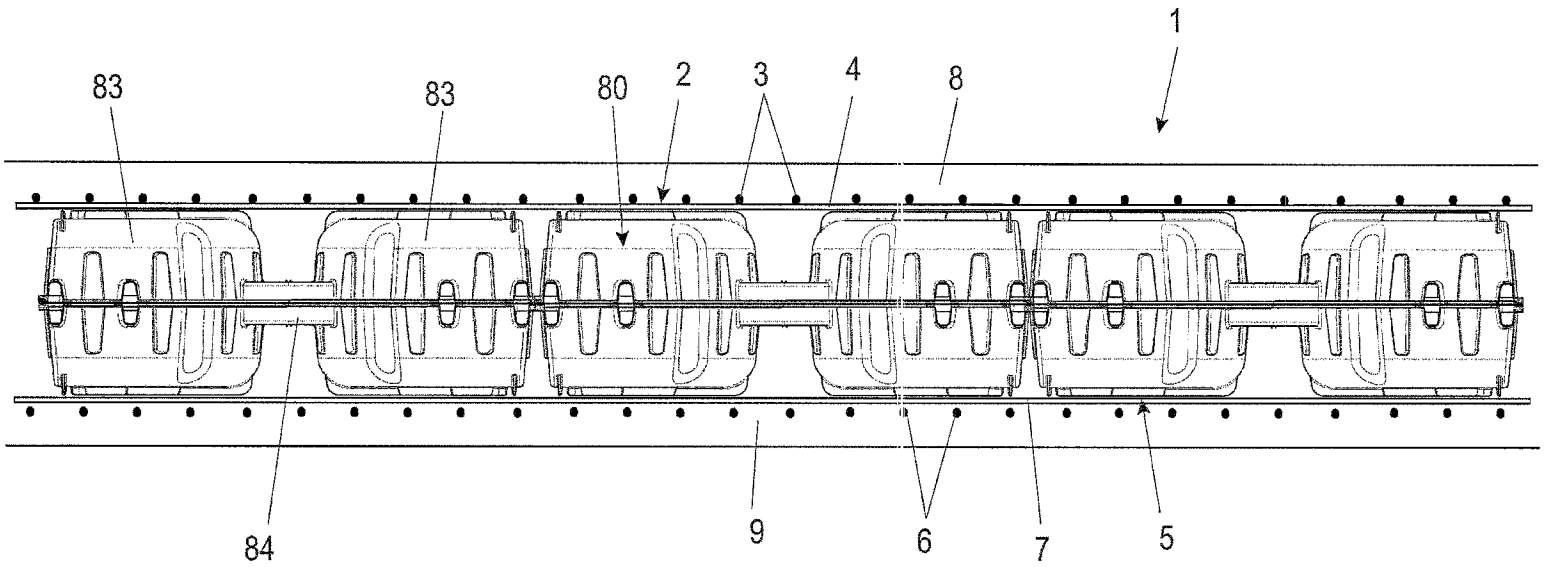
Figure 34:
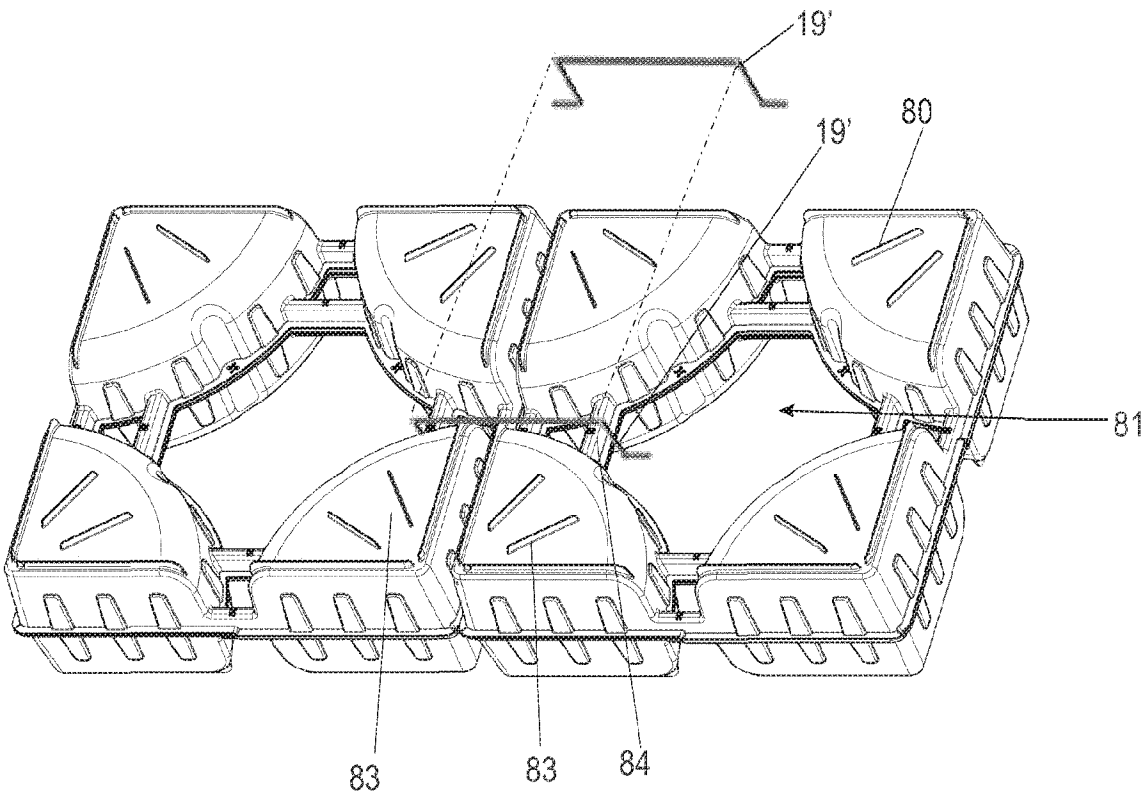
Figure 35:
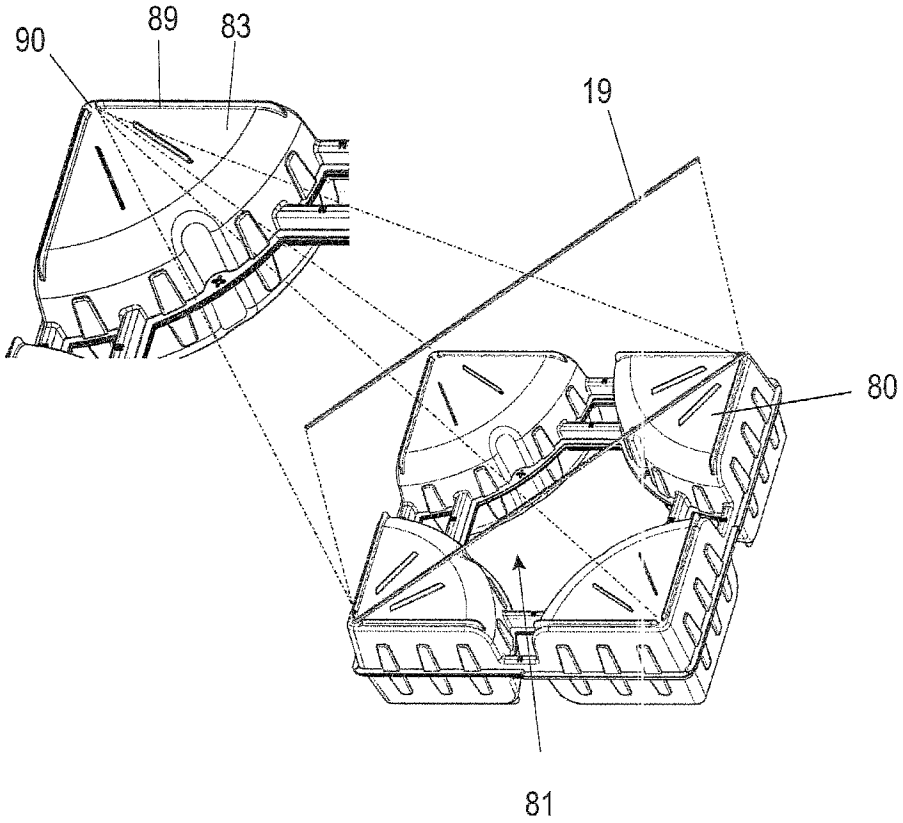
Figure 36A:
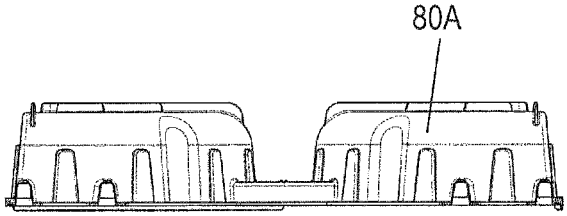
Figure 36B:
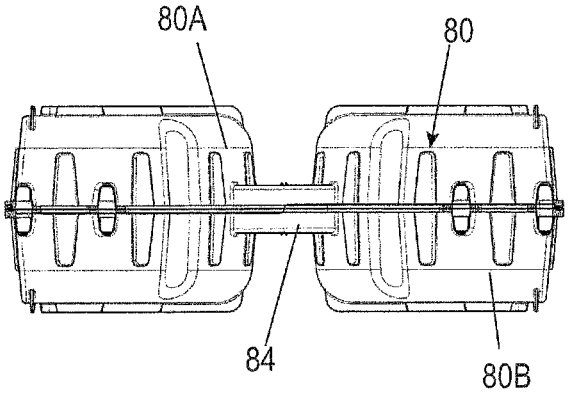
Figure 37A:
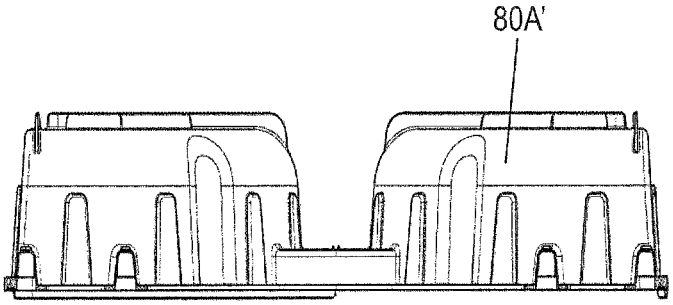
Figure 37B:
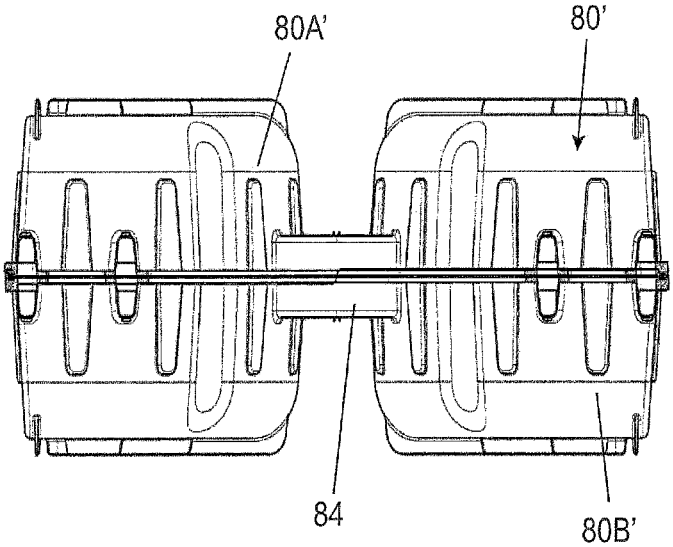
Figure 38A:
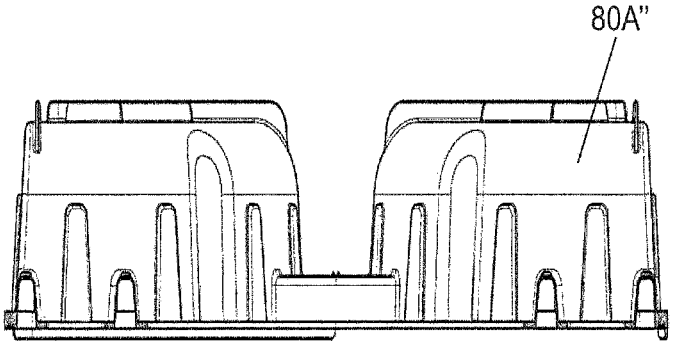
Figure 38B:
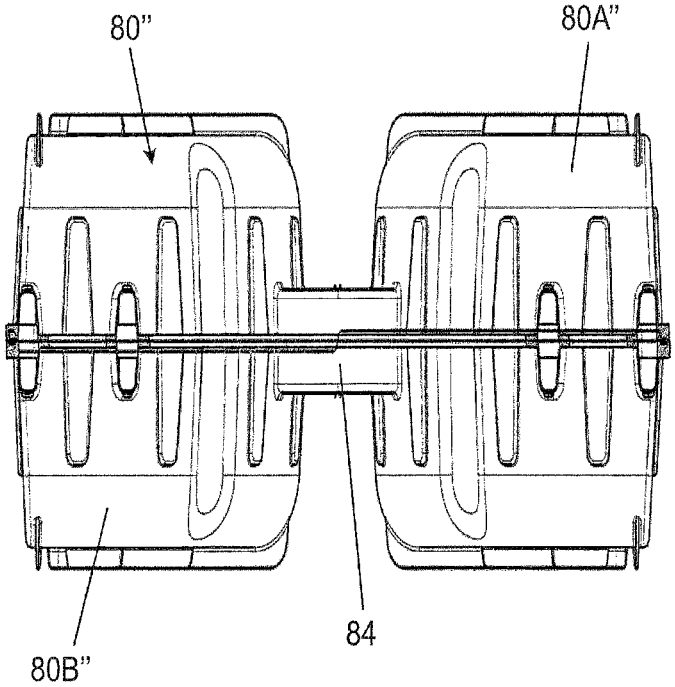

FIGS. 25A and B show two views of another embodiment example;

FIG. 26 shows a view of another embodiment example of adjacent displacement bodies;

FIGS. 27 to 30 show several views of another embodiment example of a displacement body according to invention;

FIG. 31 shows a perspective view of several displacement bodies of FIG. 27;

FIGS. 32 and 33 show two views of the displacement bodies of FIG. 31 with reinforcing meshes;

FIGS. 34 and 35 show two views of the displacement bodies of FIG. 27 with reinforcement elements, and FIGS. 36 to 38 show several views of displacement bodies with different heights.

DETAILED DESCRIPTION OF THE INVENTION

Figure 1:
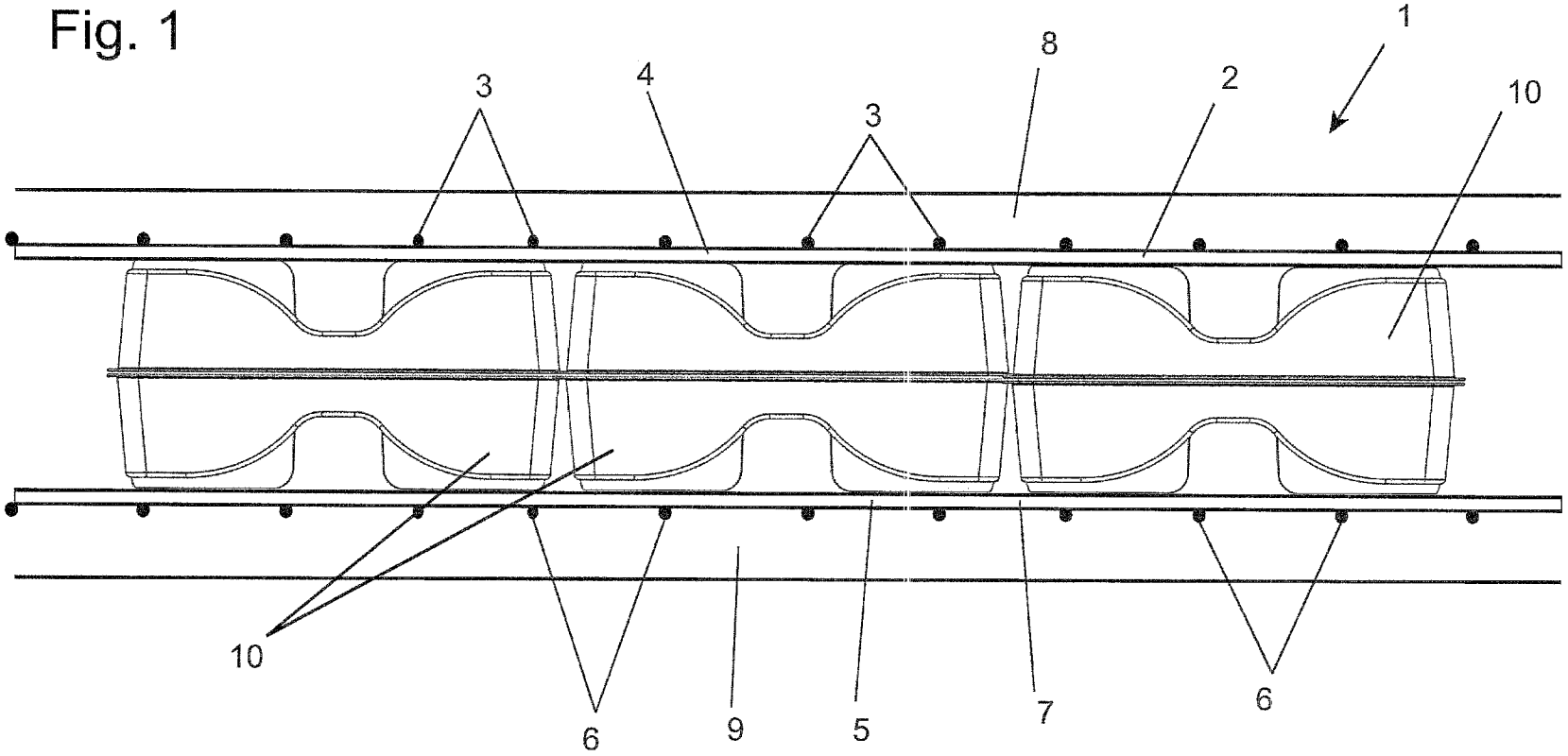
FIG. 1 shows a sectional view through a concrete ceiling according to the invention.
Figure 2:
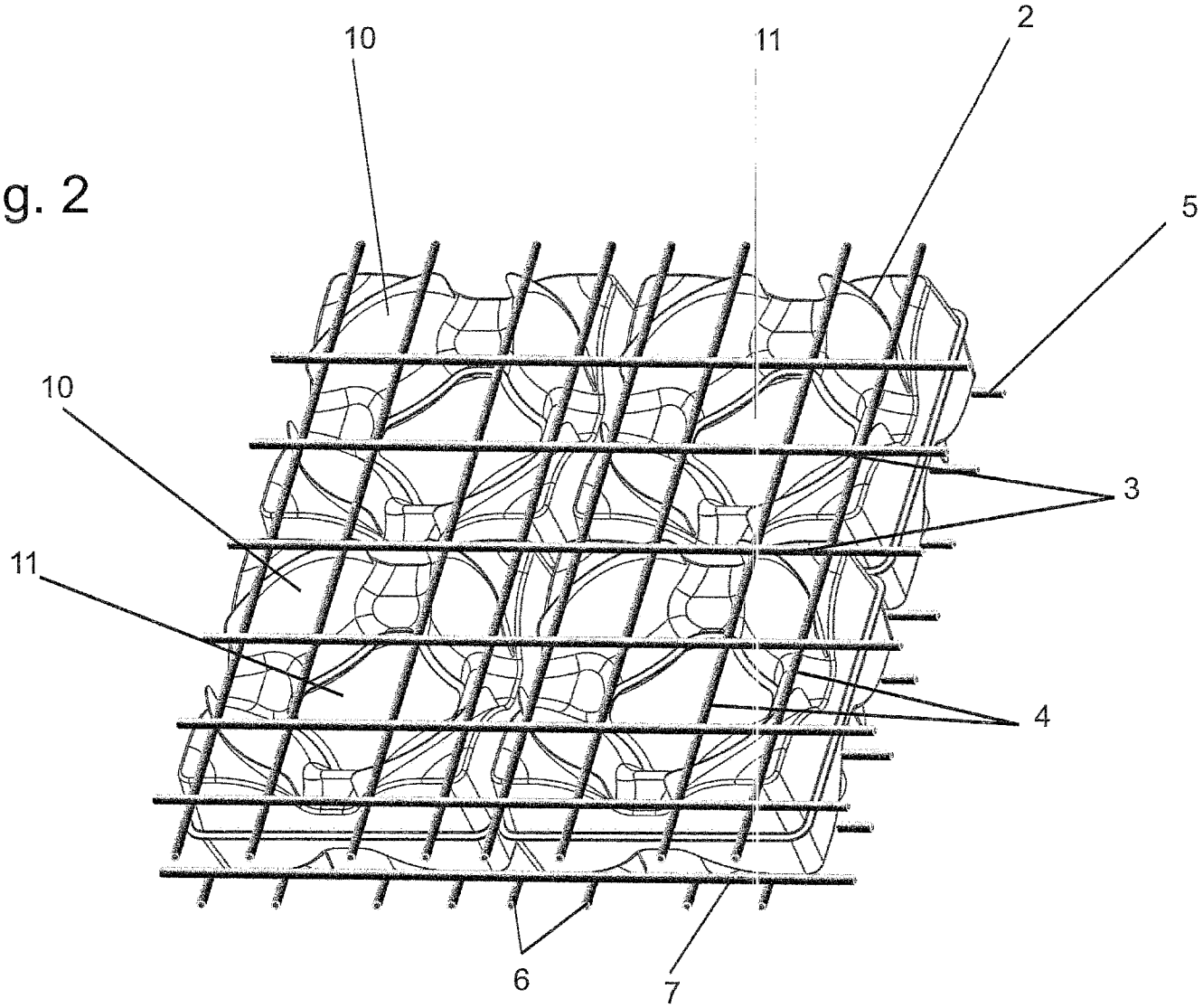
FIG. 2 shows a perspective view of the concrete ceiling of FIG. 1 without concrete.

A concrete ceiling 1 comprises an upper reinforcing mesh 2 having a plurality of longitudinal struts 3 and transverse struts 4 joined together. Furthermore, a lower reinforcing mesh 5 is provided, which also has a large number of longitudinal struts 6 and perpendicular transverse struts 7, as shown in FIGS. 1 and 2.

Between the flat reinforcing meshes 2 and 5, a plurality of displacement bodies 10 are arranged, which are made of plastic, for example, and provide a distance between the upper reinforcing mesh 2 and the lower reinforcing mesh 5. The displacement bodies 10 are adjacent to each other in an edge area and are not kept apart from each other by additional positioning means. In each displacement body 10 a channel 11 is formed, which establishes a connection between the concrete at the lower reinforcing mesh 5 and the concrete at the upper reinforcing mesh 2. The channels 11 thus create a supporting structure in the concrete ceiling 1, which is determined by the displacement bodies 10.

Figure 3:
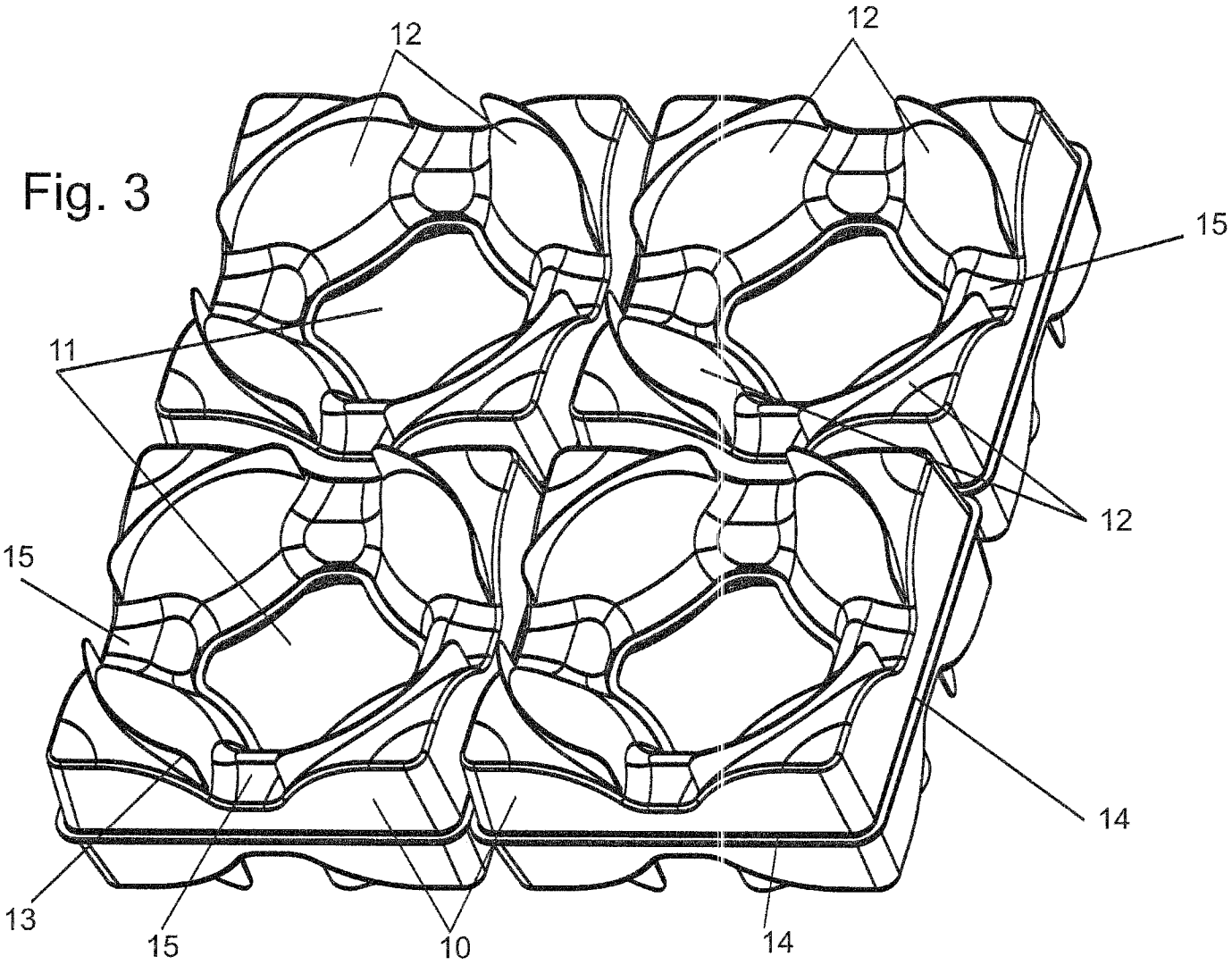
FIG. 3 shows a perspective view of the displacement bodies of the concrete ceiling of FIG. 1.

As shown in FIG. 3, each displacement body 10 around channel 11 has a ring-shaped section 12 with protrusions and recesses 15 in between. Each channel 11 is diamond-shaped in plan view, but can also be formed in a circular or square manner. Channel 11 has the narrowest cross-section in a central region of displacement body 10 and then widens outwards. The recesses 15 ensure that the channels 11 can be filled safely when concrete is introduced, wherein the concrete forms spreading supporting webs within the recesses 15.

Each displacement body 10 has a laterally protruding edge 14 at a medium height, which serves to position an adjacent displacement body 10.

Figure 4:
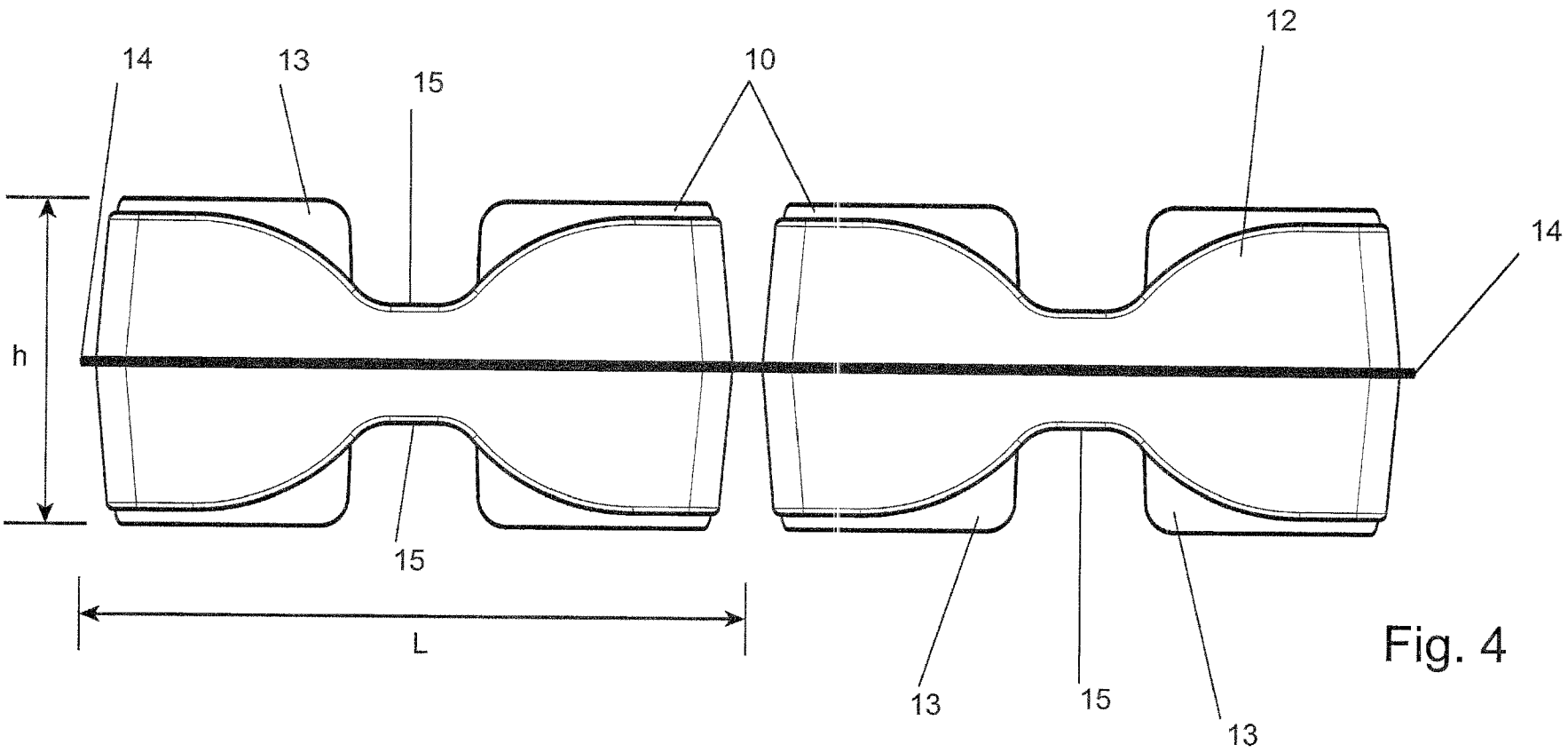
FIG. 4 shows a side view of two displacement bodies of the concrete ceiling of FIG. 1.

FIG. 4 shows two displacement bodies 10 in a side view. At projections or ring-shaped sections 12, webs 13 protrude, surrounding the recesses 15. A height h of the displacement body is preferably in a range between 40 mm and 400 mm, in particular 80 mm to 300 mm.

The displacement bodies 10 are square in plan view, so that a width L at both side edges is approximately equal, wherein the width is in a range between 300 mm to 700 mm, in particular 400 mm to 600 mm.

Channel 11 has an area of at least 100 $cm^2$ at its narrowest point, in particular more than 150 $cm^2$. If the narrowest cross-sectional area is circular, the diameter shall preferably be in the range 200 mm to 450 mm, in particular 250 mm to 400 mm.

The ratio of the area of the channel 11 in the area of the narrowest cross-section to the total area of the displacement body 10 in plan view is preferably at least 0.1, for example between 0.2 and 0.45, in particular 0.3 to 0.4. Thus a "concrete column" is formed by the channel 11 within the displacement body 10, the geometric dimensions of which are predetermined and which therefore enables a comparatively accurate calculation of the load-bearing capacity.

Figure 5:
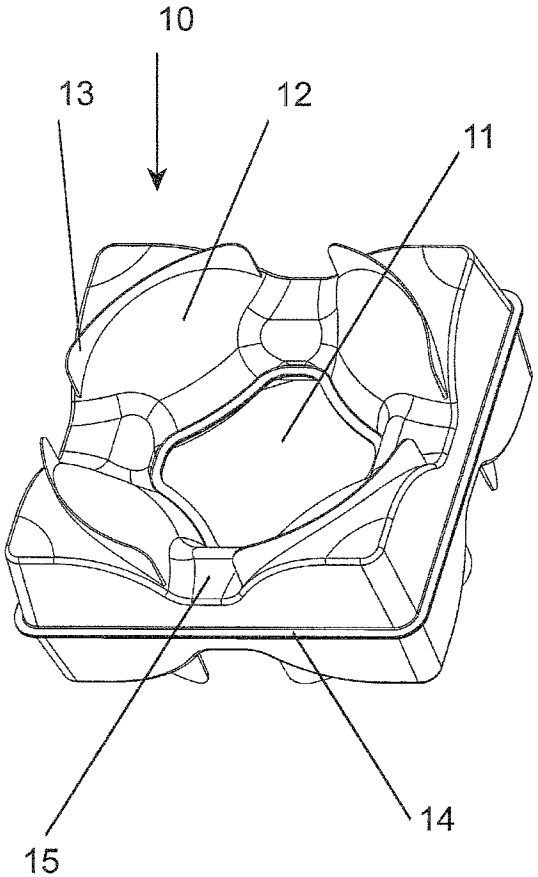
FIG. 5 shows a perspective view of a displacement body of the concrete ceiling of FIG. 1.
Figure 6B:
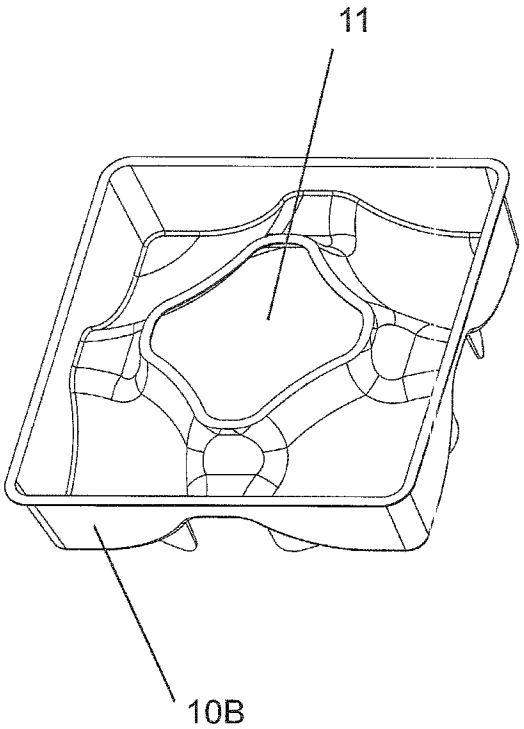
FIGS. 6A and 6B show two views of the half-shells of the displacement body of FIG. 5.
Figure 6A:
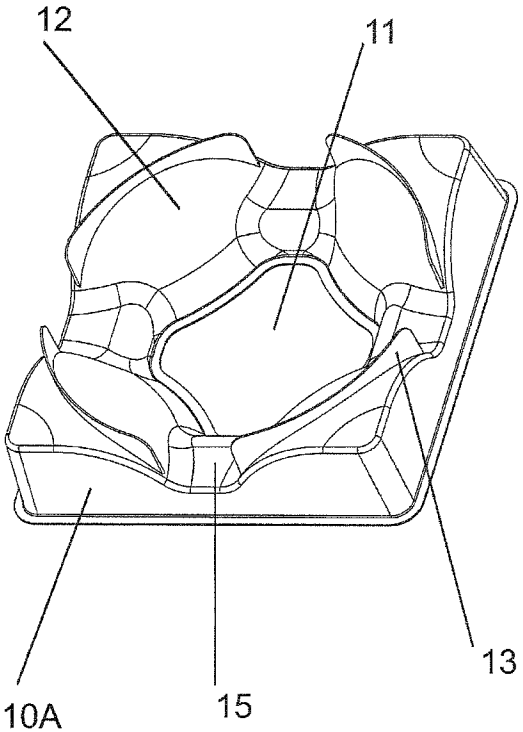

FIG. 5 shows a displacement body 10 which can be loosely placed on a lower reinforcing mesh 5 for the production of a concrete ceiling 1. Neighboring displacement bodies 10 are positioned to abut one another, except for those displacement bodies 10 which are arranged in an edge region of the concrete ceiling 1, since an adjacent displacement body 10 is missing in these displacement bodies at least on the outer side.

In the embodiment example shown, each displacement body 10 is made up of two half-shells 10A and 10, which can be plugged together and surround a cavity. The cavity within the displacement body 10 can optionally contain air, but also a filling element, for example a foam body.

Figures 7, 8:
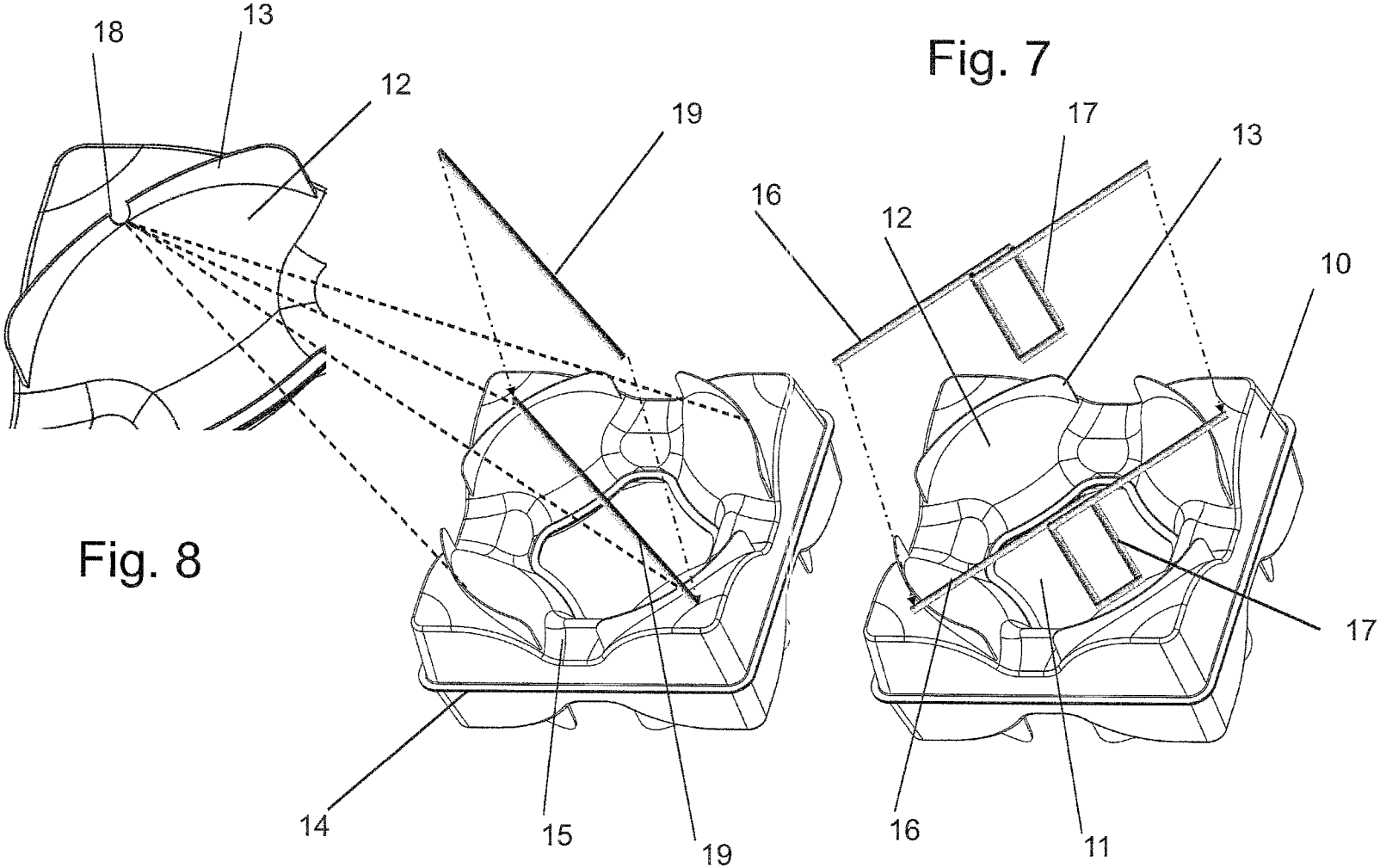
FIG. 7 shows a perspective view of a displacement body with an optional reinforcement element.
FIG. 8 shows a view of a displacement body with an optional modified reinforcement element.

To increase the strength, it may be useful to provide at least 10 reinforcement elements 16 on individual displacement bodies, as shown in FIG. 7. Such a reinforcement element 16 may be formed by a bent wire comprising, for example, a loop 17 inserted into channel 11. The reinforcement element 16 is fixed to the edge 13 of the displacement body 10 with two struts.

As shown in FIG. 8, a recess 18 can be provided on the web 13, into which a strut of a reinforcement element can be inserted. The reinforcement element 19 can also be bar-shaped without a loop 17.

Figure 9:
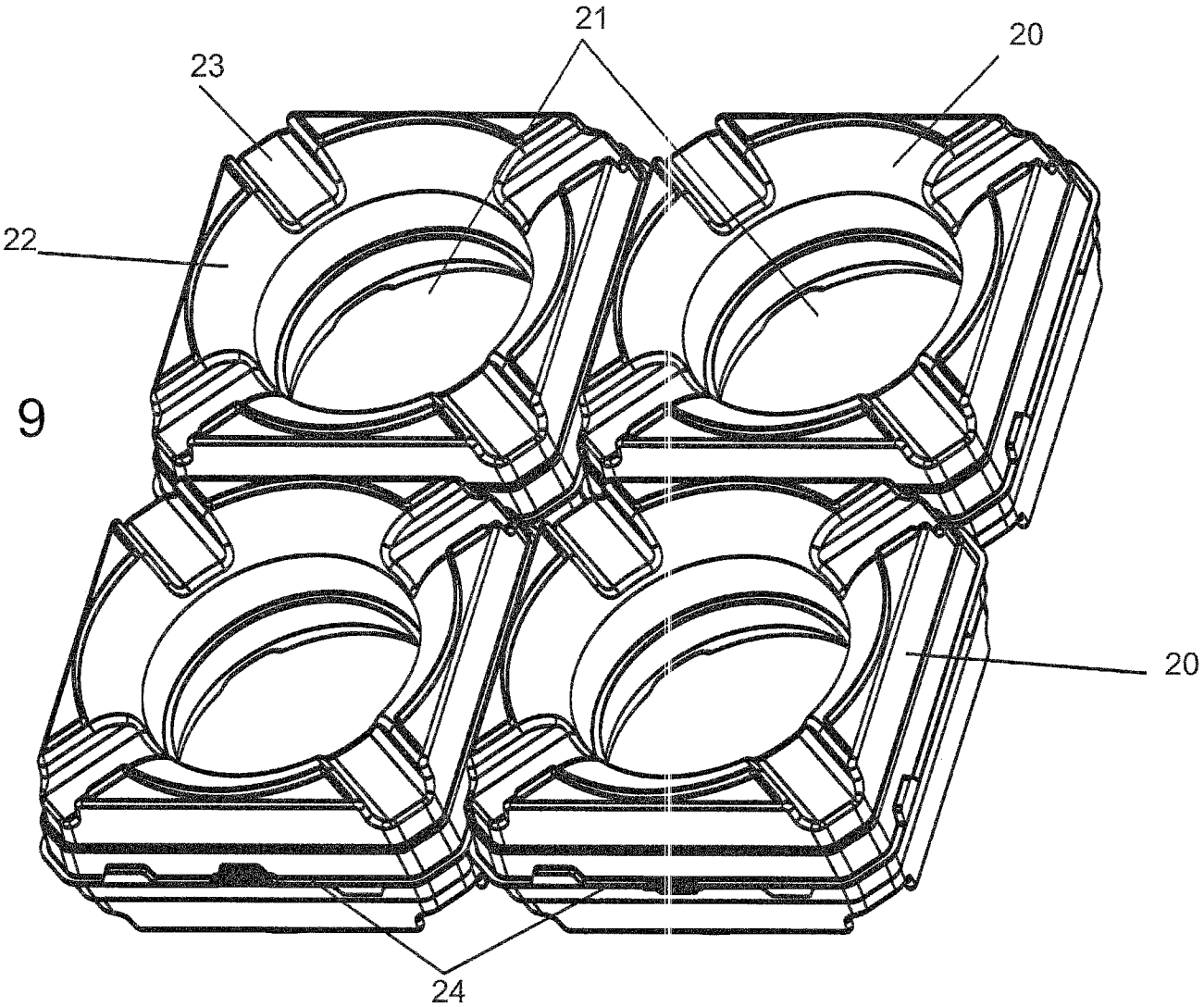
FIG. 9 shows a perspective view of several displacement bodies according to a second embodiment example.
Figure 10:
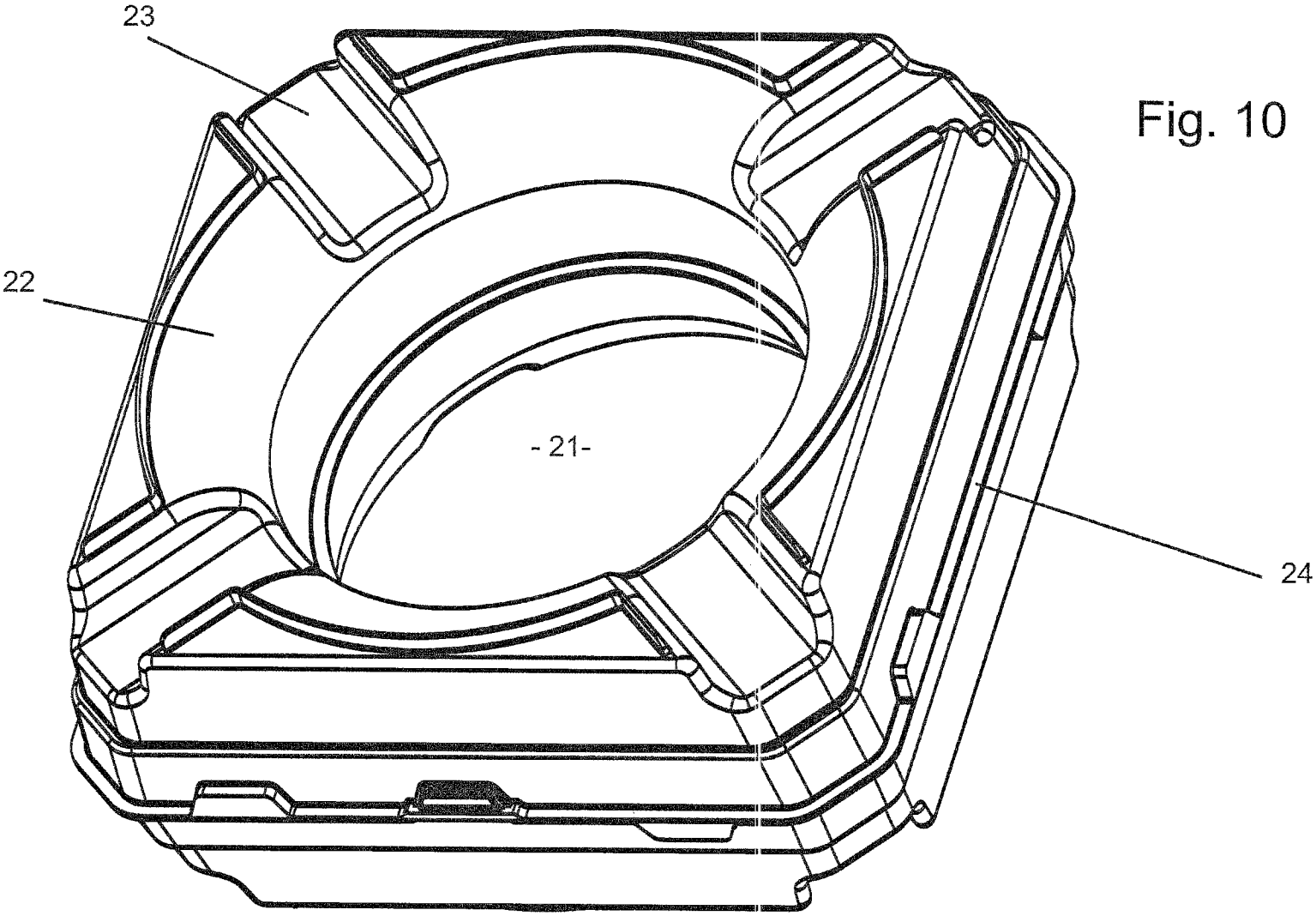
FIG. 10 shows a perspective view of a displacement body of FIG. 9.

FIG. 9 shows a modified embodiment example of a unit of displacement bodies 20 having a channel 21 in the central region which is circular in cross-section, wherein each channel 21 has a narrowest cross-section in a central region of the displacement bodies 20. A ring-shaped section 22 of the displacement body 20 is formed around each channel 21. At each annular section 22, a recess 23 is provided in the corner area to allow concrete to flow into channel 21. The displacement bodies 20 have ridges or edges 24 on the outer side surfaces, which serve to position the adjacent displacement bodies 20.

Figure 11B:
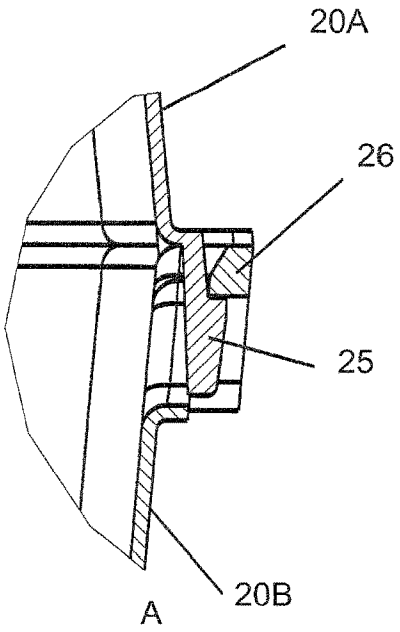
FIGS. 11A to 16 show several views of the displacement body of FIG. 10, partly in section.
Figure 11A:
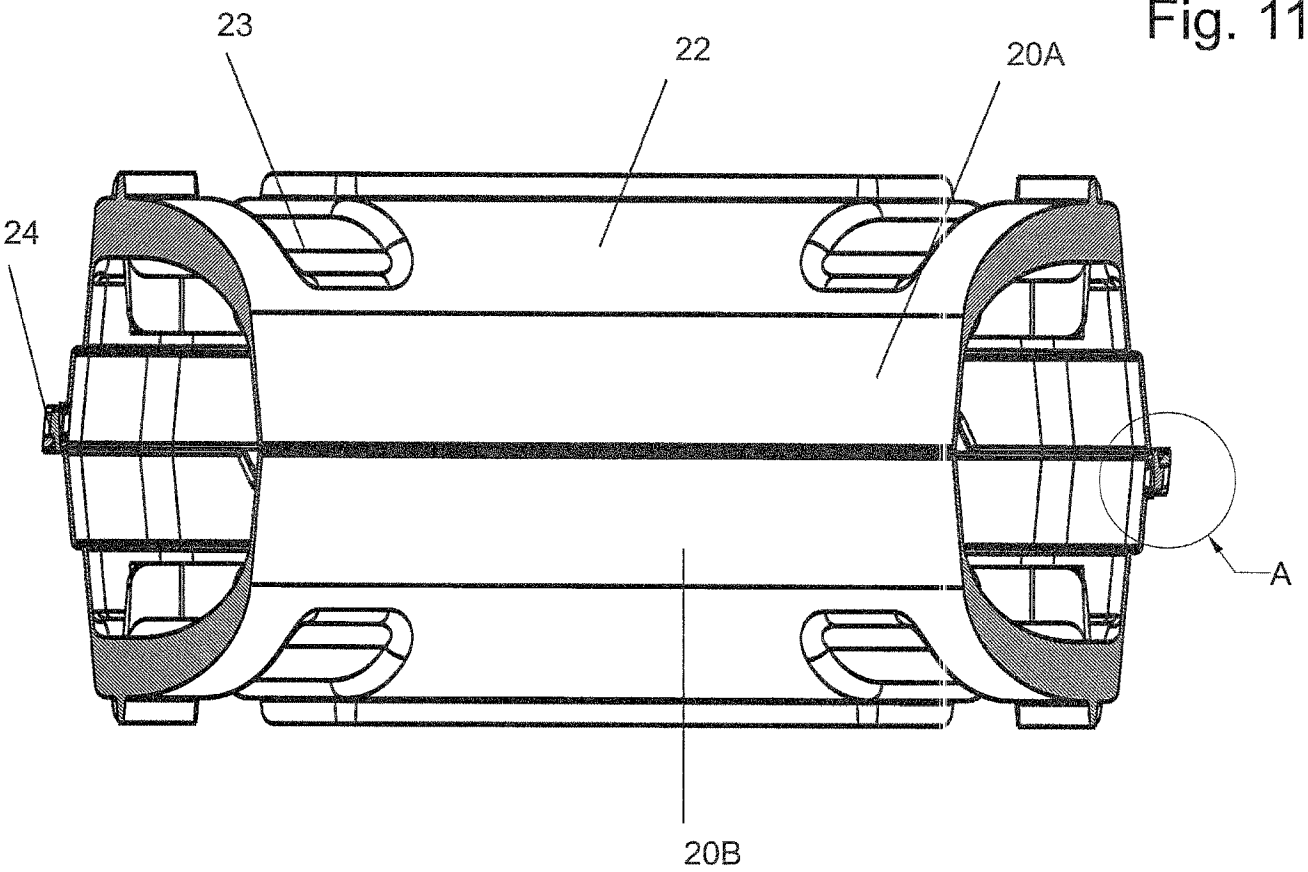

As shown in FIGS. 11A and 11B, the displacement bodies 20 are made up of two half-shells 20A and 20B, which can be fixed to each other using locking or retaining elements. On the lower half-shell 20B there is a latching receptacle 26, into which a latching web 25 engages on the upper half-shell 20A, as shown in FIG. 11B. Several of these latching connections can be provided over the circumference to fix the 20A and 20B half-shells together.

Figure 12B:
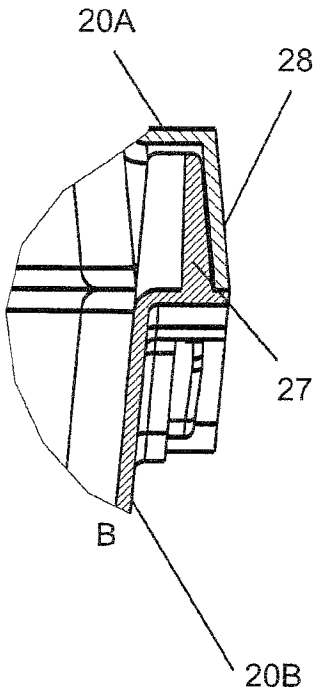
Figure 12A:
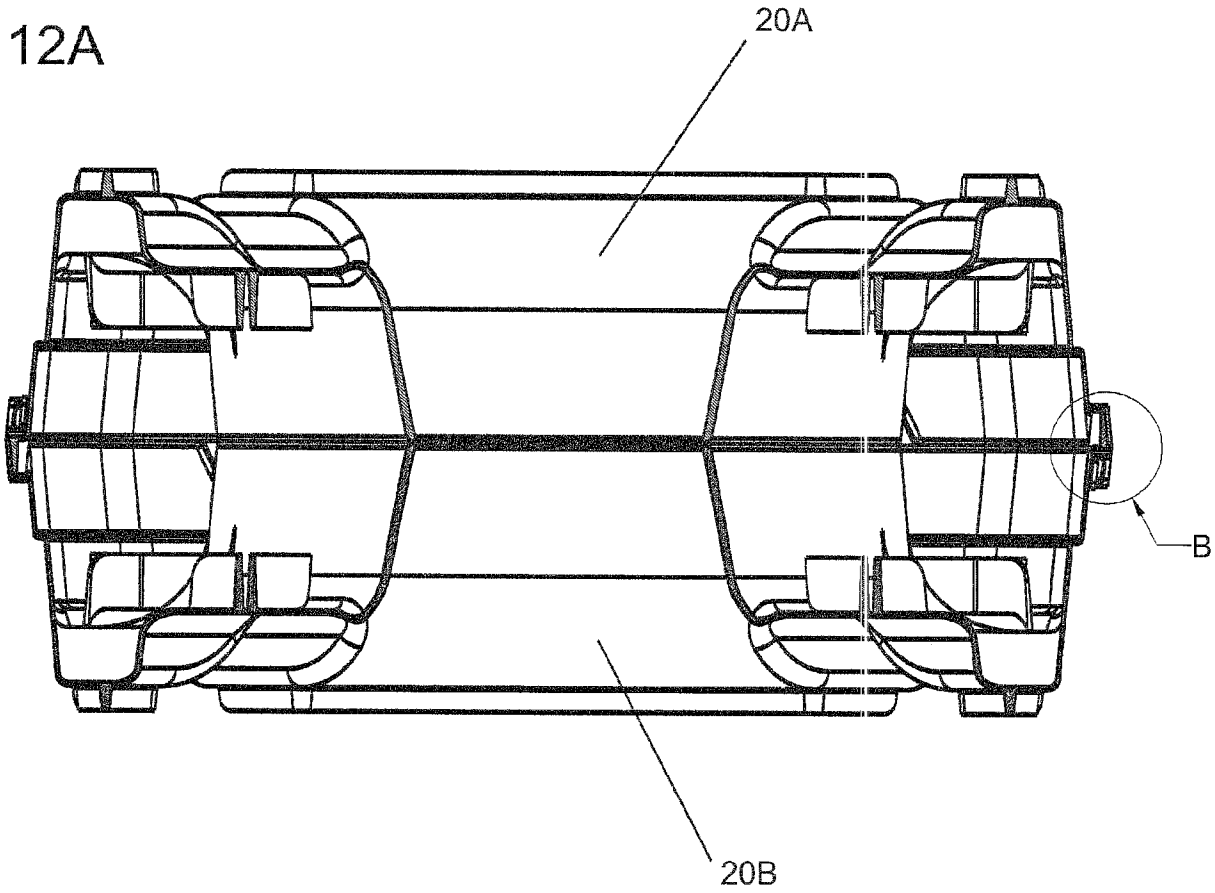
Figure 13:
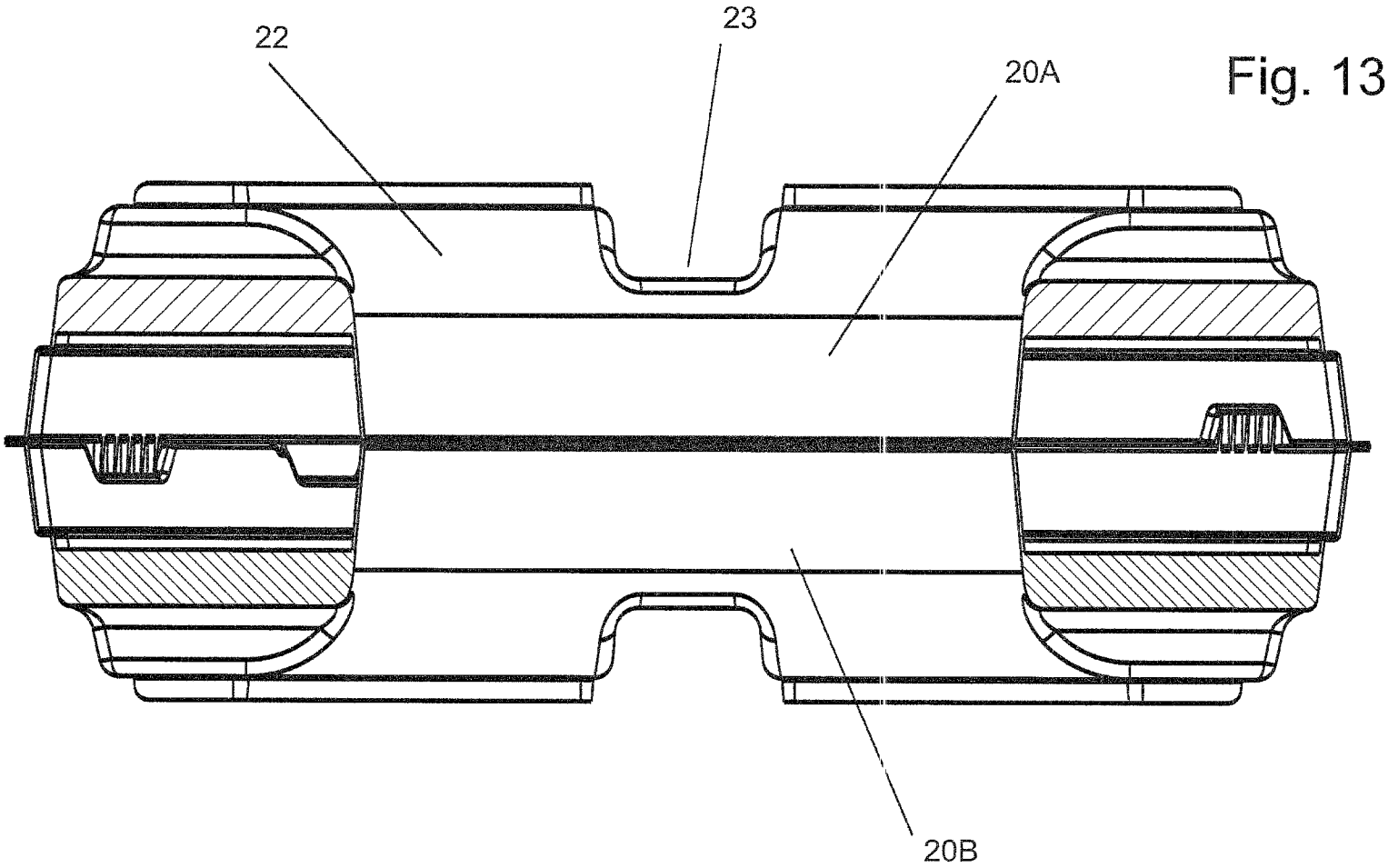

FIGS. 12A and 12B show a section through the displacement body 20 in the area of holding elements. At the lower half-shell 20B a retaining web 27 projects upwards, which engages in a receptacle 28 at the upper half-shell 20A, so that in the edge area between the two half-shells 20A and 20B takes place.

Figure 14:
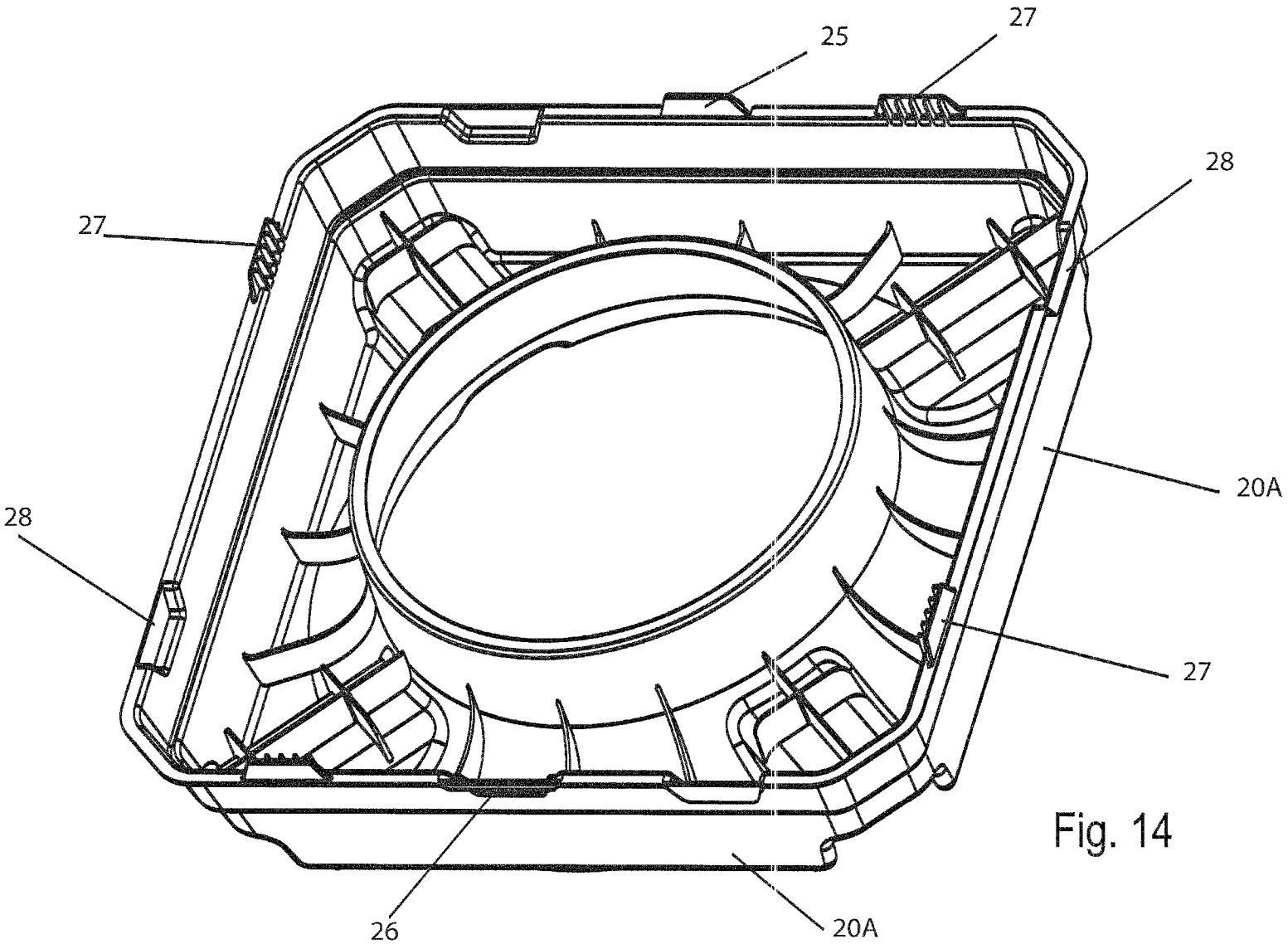

FIG. 14 shows the upper half-shell 20A inside, wherein the lower half-shell 20B can be identical, wherein the half-shells 20A and 20B can be inserted into each other offset by 180°. In the edge area there are latching webs 25, latching receptacle 26, retaining webs 27 and receptacles 28 for reinforcing the edge area. An edge 24 of the displacing body 20 is thus comparatively dimensionally stable and can be used to position adjacent displacement bodies 20.

Figure 15:
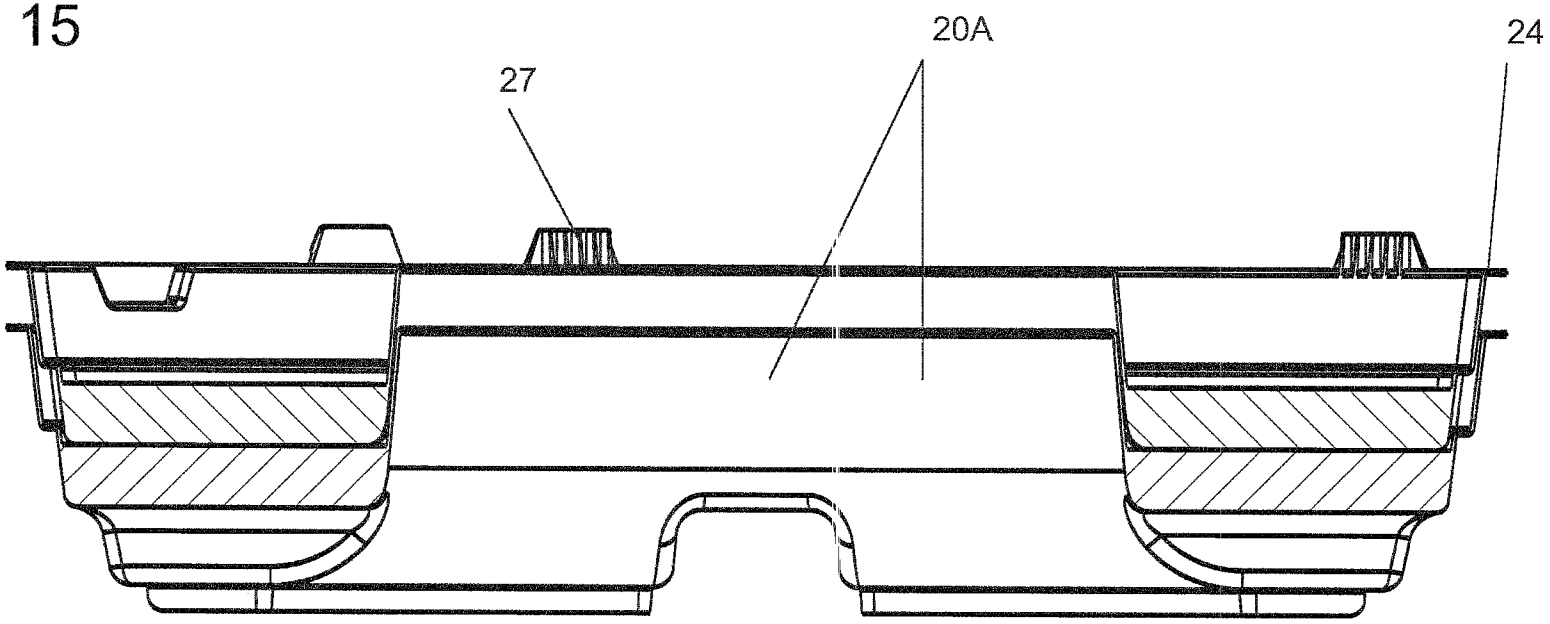
Figure 16:
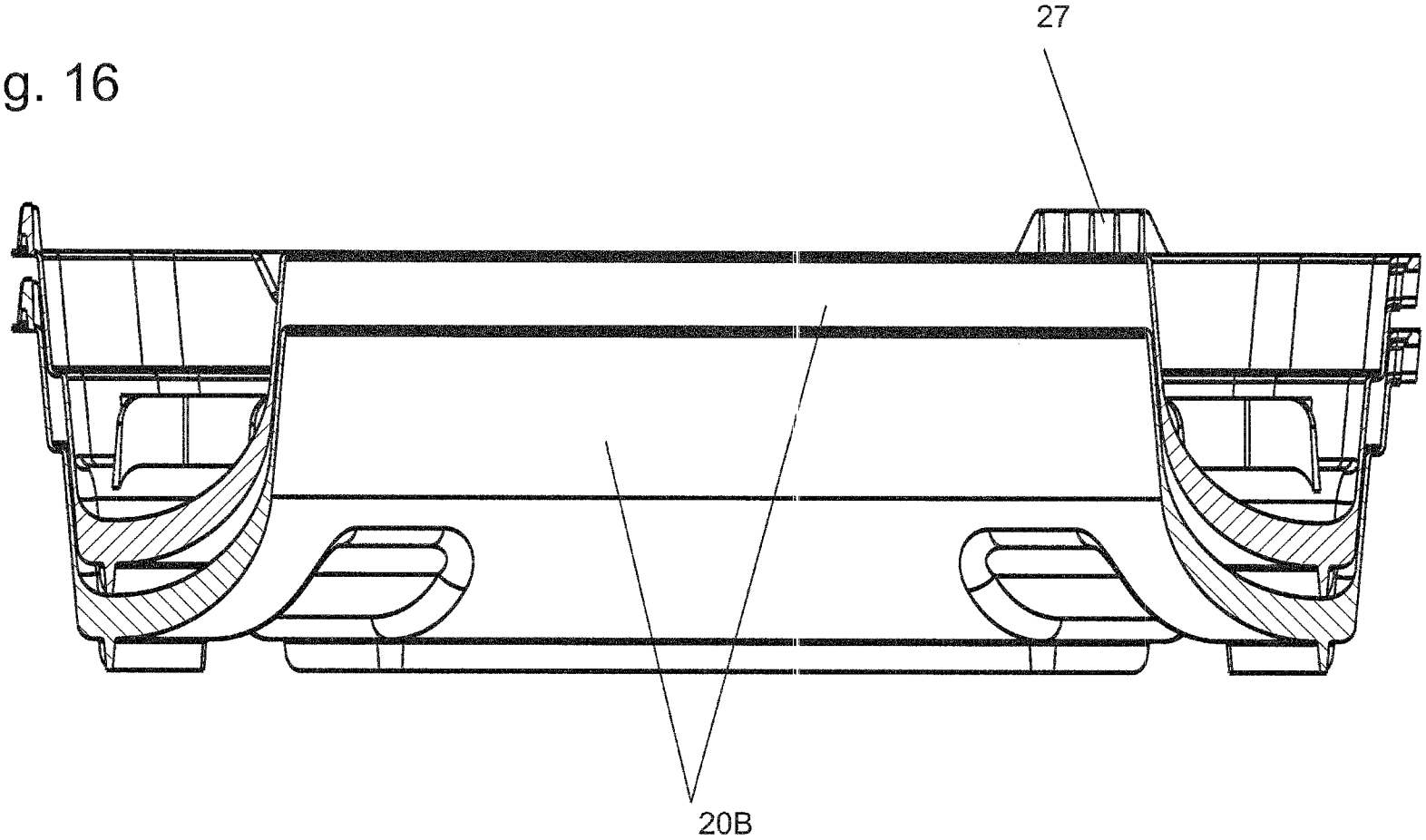

FIG. 15 shows two half-shells 20A in a stacked position and FIG. 16 shows two half-shells 20B in a stacked position.

Figure 17:
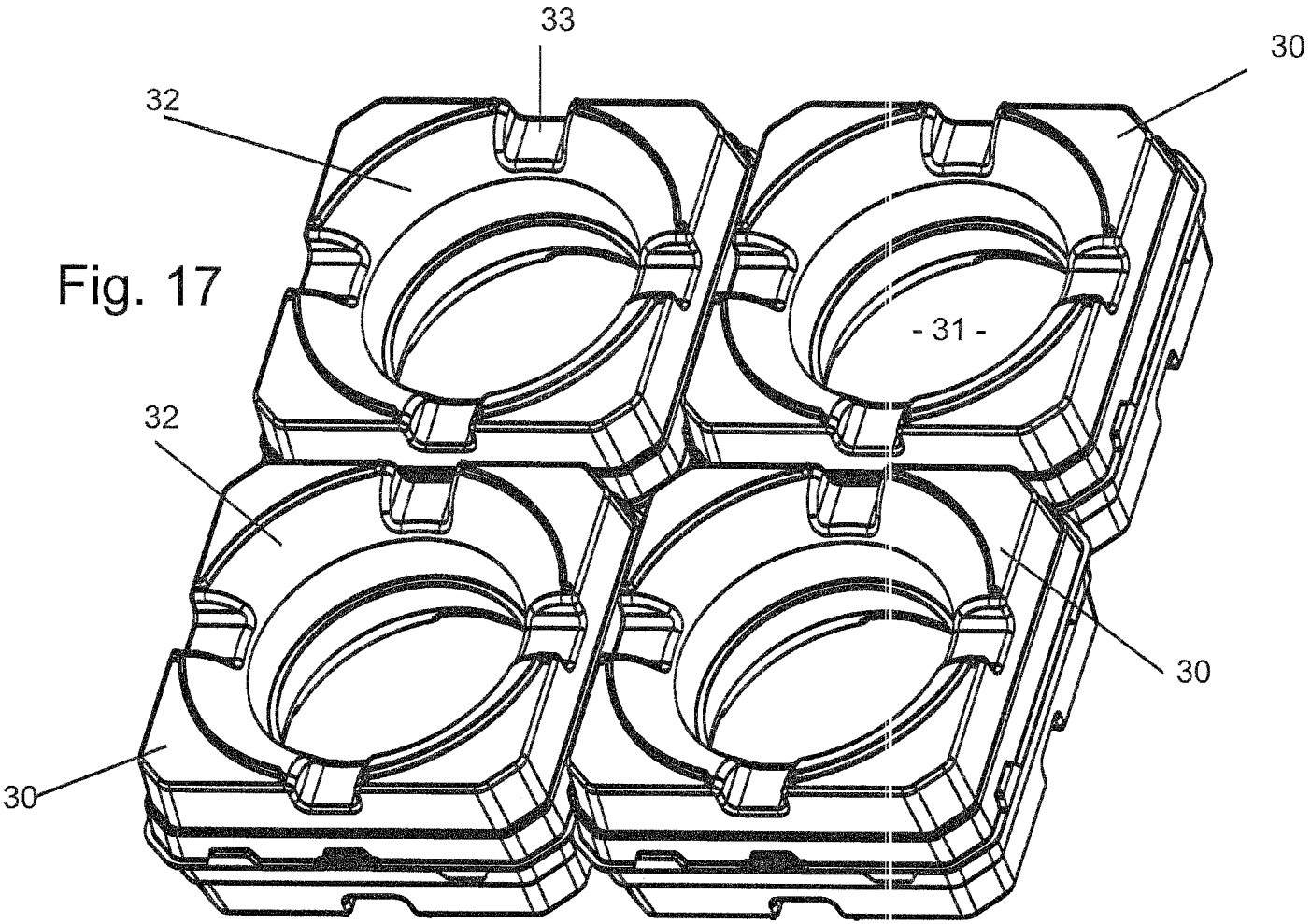
FIG. 17 shows several displacement bodies according to a third embodiment example.
Figure 18:
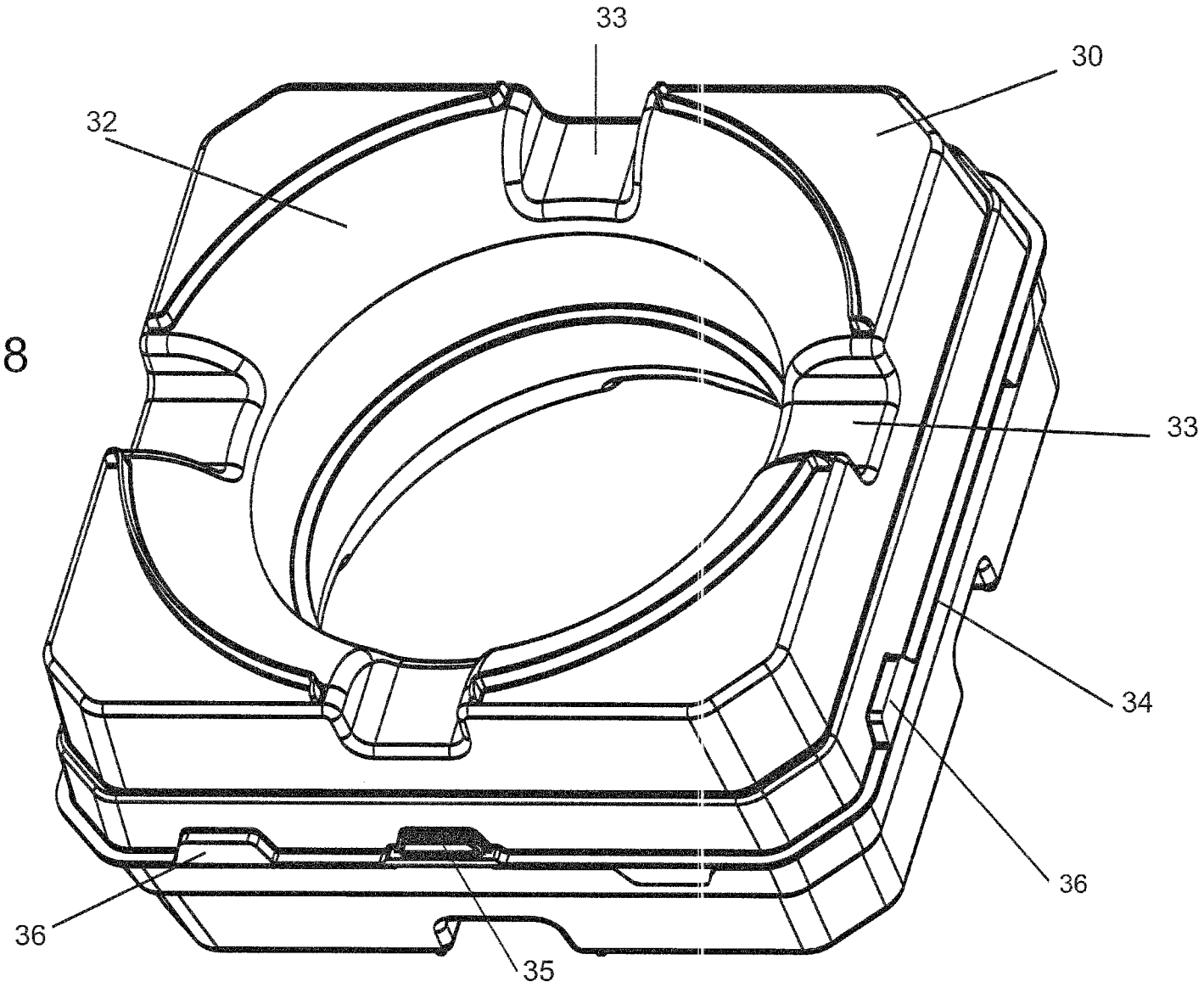
FIG. 18 shows a perspective view of a displacement body of FIG. 17.

FIGS. 17 and 18 show a further embodiment example of displacement bodies 30, which are square in plan view and each have a channel 31 in the middle which is circular in cross-section. Each channel 31 is surrounded by a ring-shaped section 32 of the displacement body, which has recesses 33 on four sides. However, the recesses 33 are not located in the corner area, but in the middle of a side surface of the displacement body 30. The displacement bodies 30 have an outer edge 34 which serves to position adjacent displacement bodies 30, wherein the edge 34 may be provided with latching webs 35, retaining webs 36 or other means of positioning.

Figure 19:
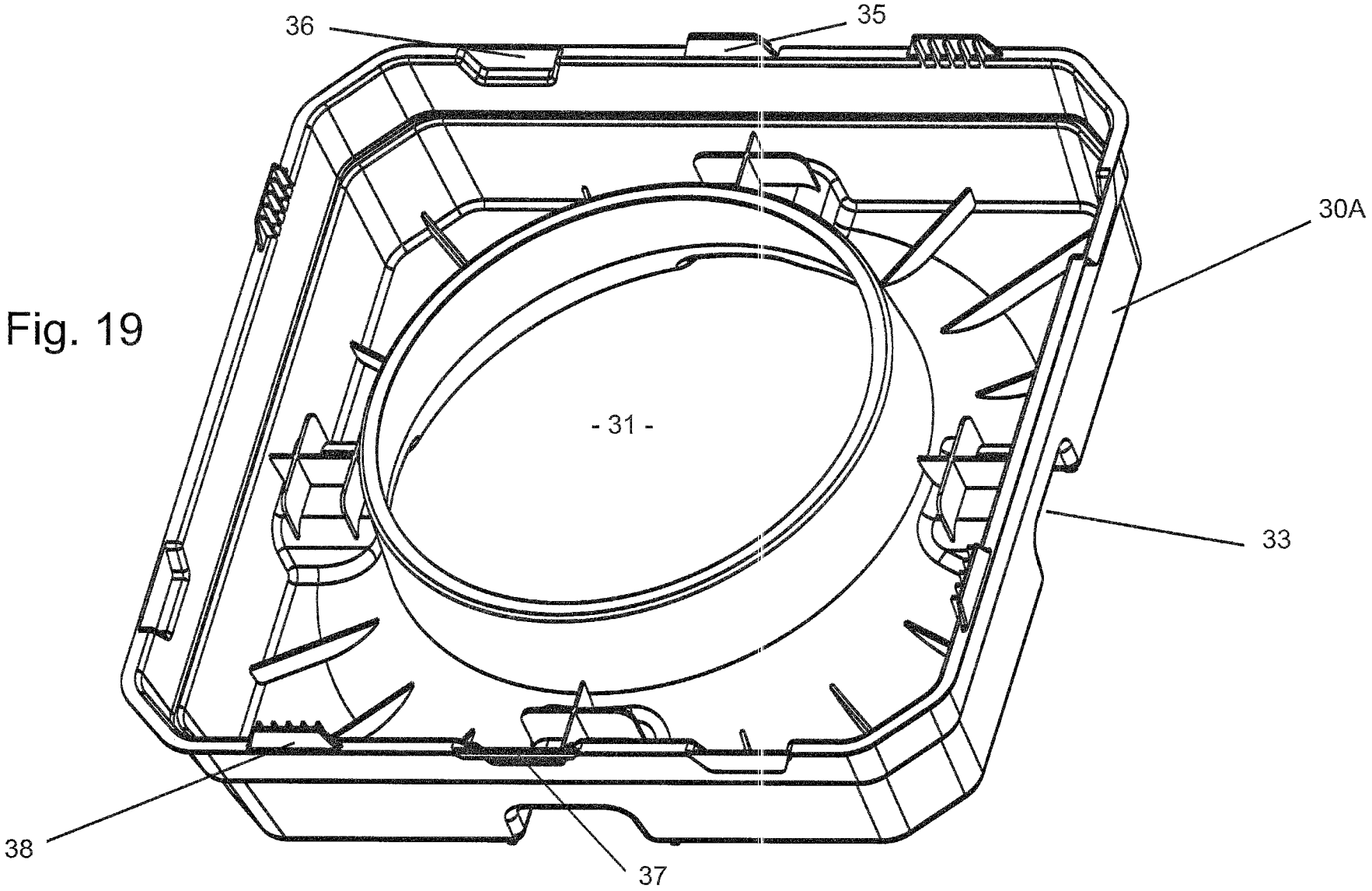
FIG. 19 shows a view of a half-shell of a displacement body of FIG. 18.

FIG. 19 shows a half-shell 30A of a displacement body 30 having a circumferential edge, on which a latching web 35, a latching receptacle 37 and a retaining web 36 and a retaining web 38 are formed.

Figure 20:
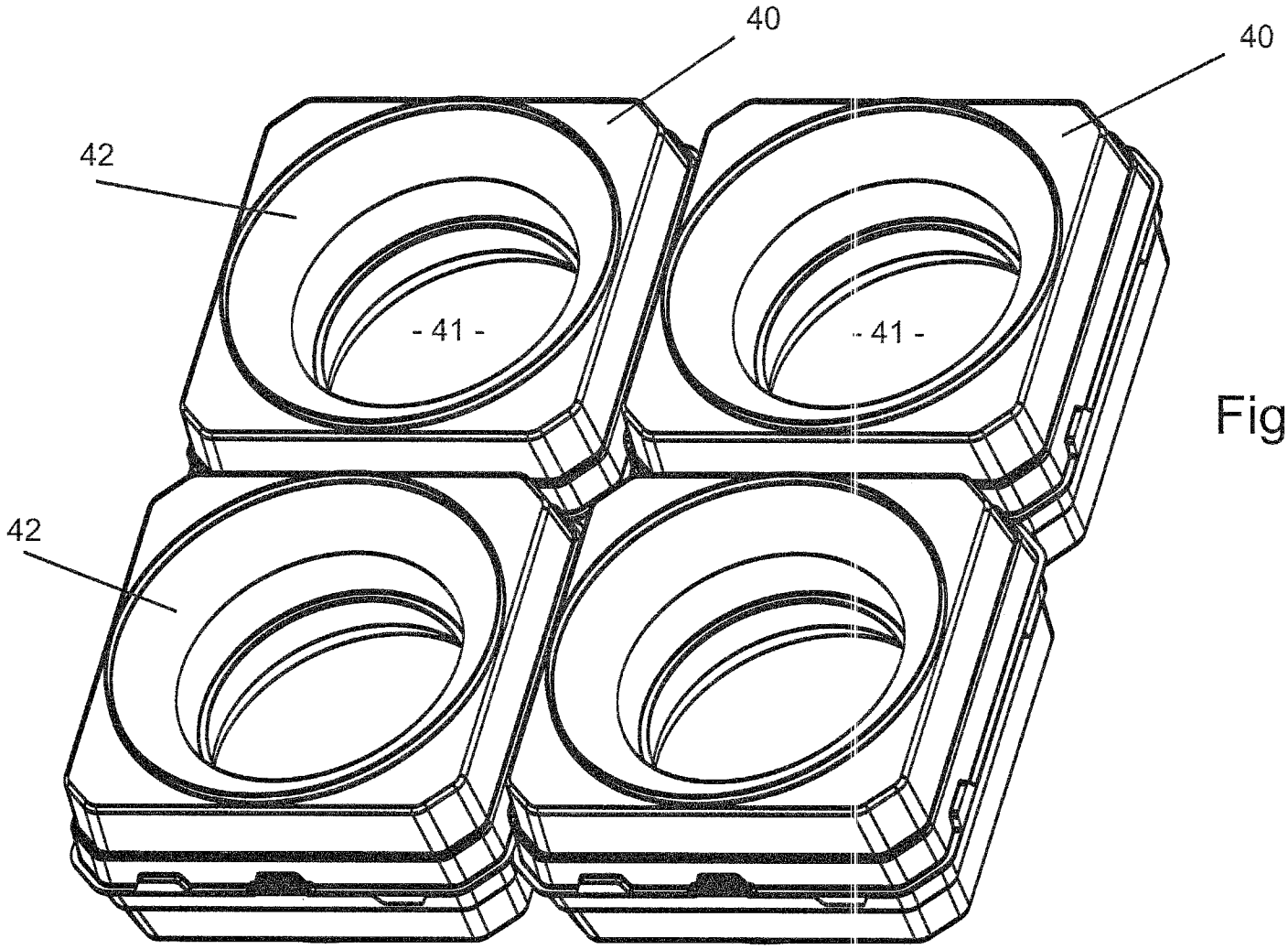
FIG. 20 shows a perspective view of several displacement bodies according to a fourth example.
Figure 21:
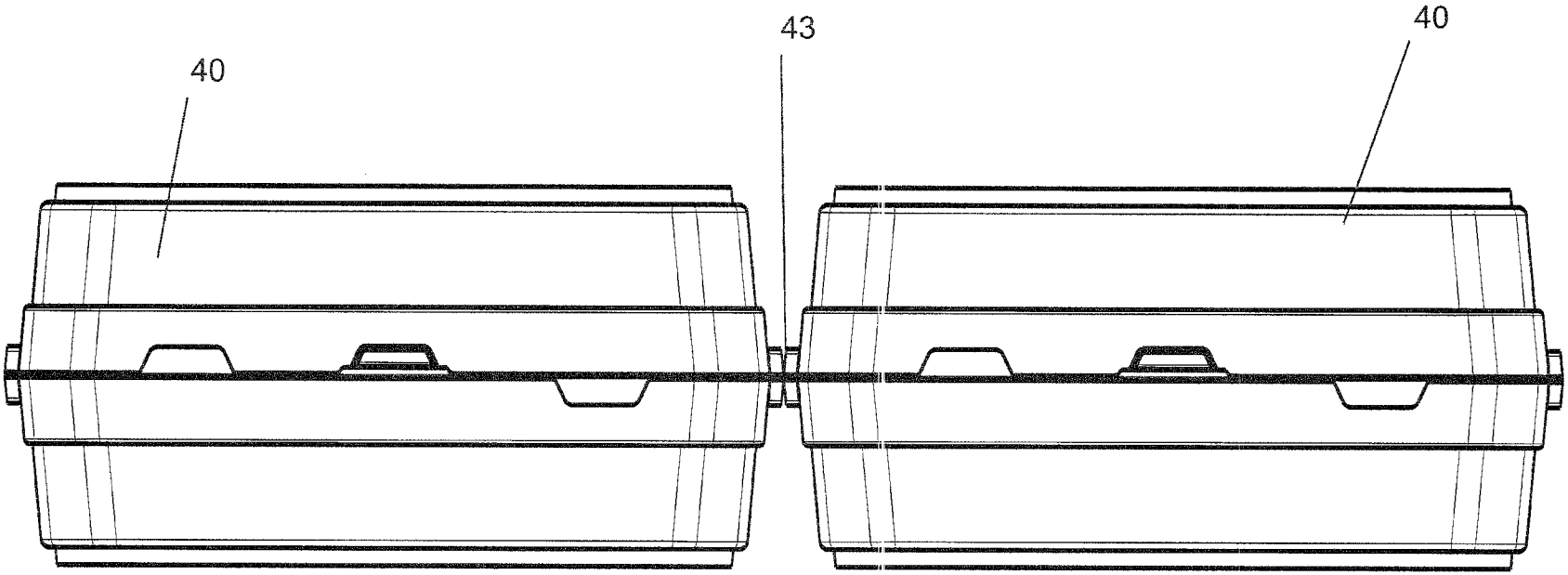
FIG. 21 shows a view of two adjacent displacement bodies of the figure.

FIGS. 20 and 21 show embodiment examples of displacement bodies 40, which are square in plan view and comprise a channel 41 with a circular cross-section in the middle. Each channel 41 is surrounded by an annular section 42 on the displacement body 40, wherein the annular section 42 is formed without recesses. Each displacement body 40 has an edge section 43 that can be used to position an adjacent displacement body 40, as shown in FIG. 21.

Figure 22:
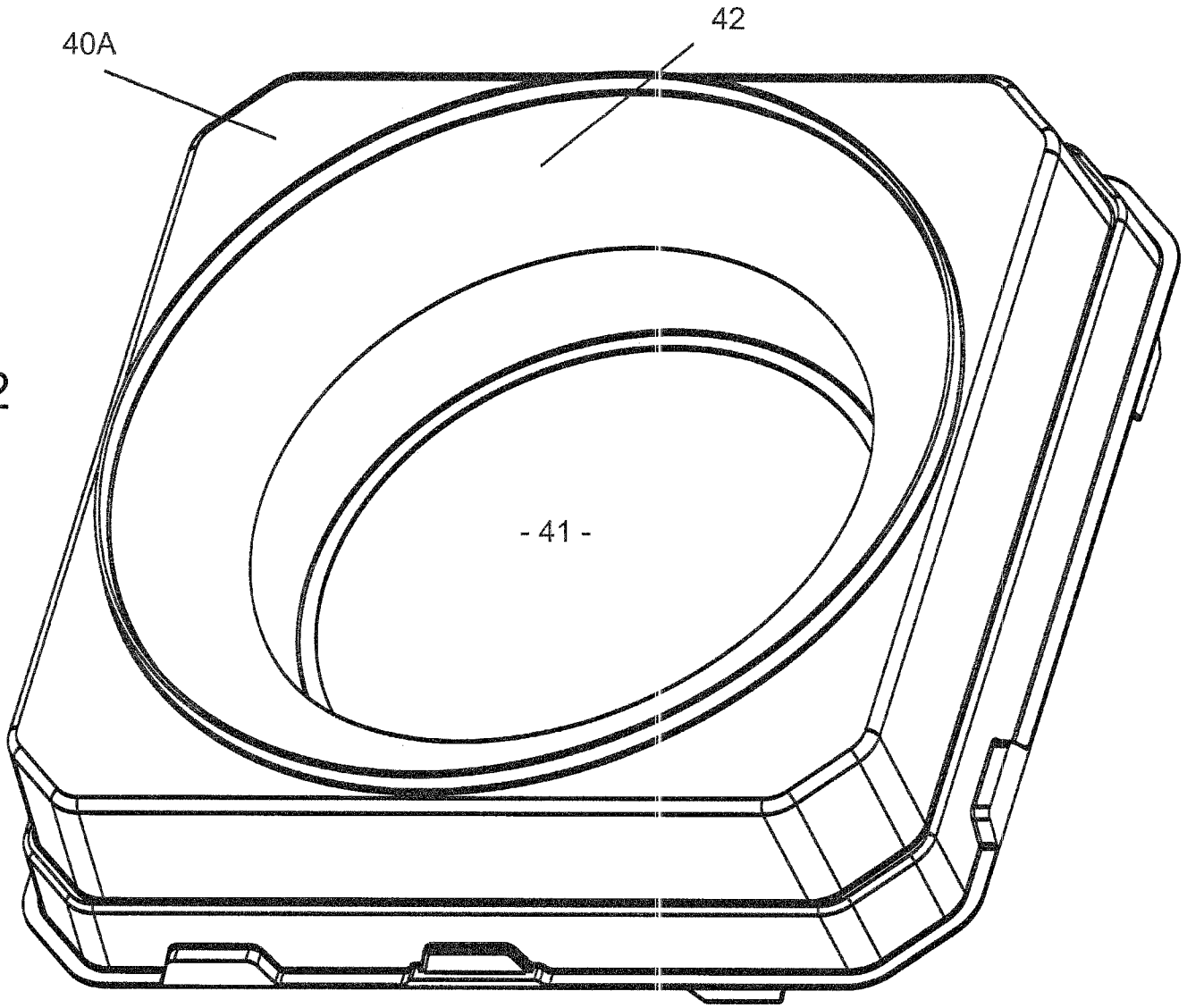
FIG. 22 shows a perspective view of a displacement body of FIG. 20.

FIG. 22 shows a half-shell 40A of a displacement body 40 and the displacement bodies 40 can be made from two half-shells 40A.

Figure 23:
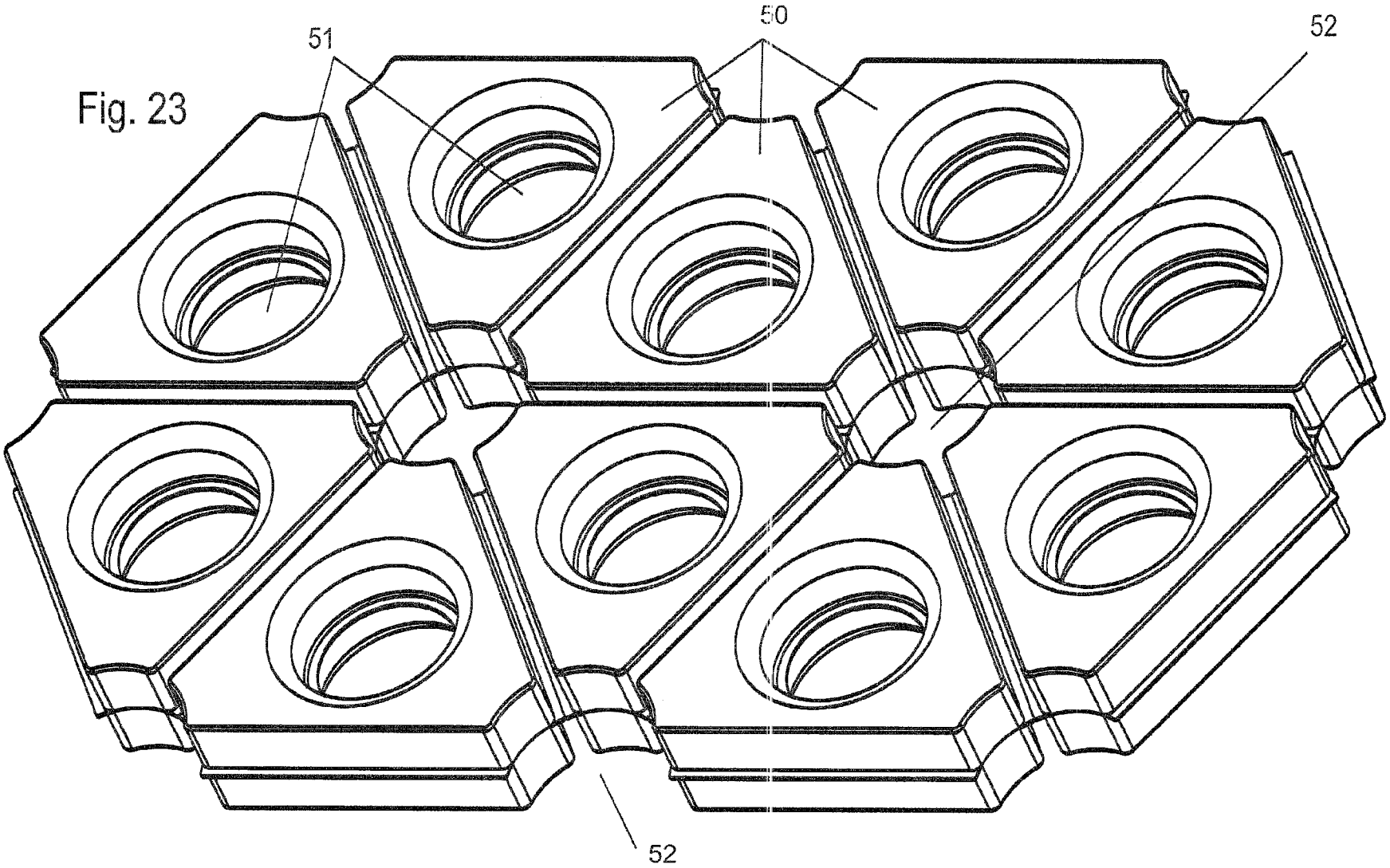
FIG. 23 shows a perspective view of several triangular displacement bodies in plan view.
Figure 24:
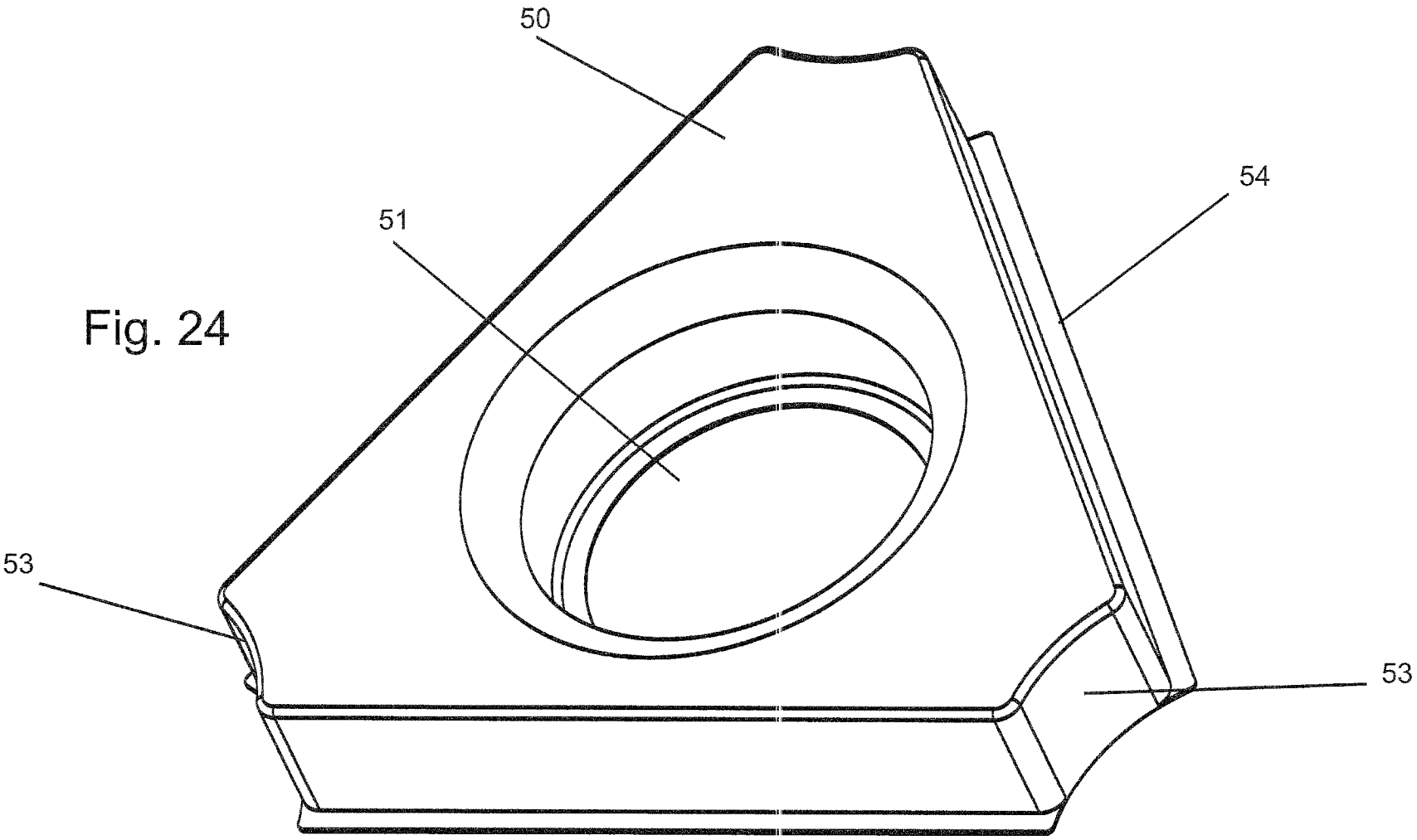
FIG. 24 shows a view of a displacement body of FIG. 23.

FIGS. 23 and 24 show another embodiment example of displacement bodies 50, which in plan view are not square but triangular in shape. Each displacement body 50 contains a channel 51 having a circular cross-section. The displacement body 50 has flattened portions 53 at the three tips of the triangle, which form free spaces 52 in an assembled position of the displacement body 50, so that the concrete in the area of the lower reinforcing mesh 5 is connected to the concrete in the area of the upper reinforcing mesh 2 not only through the channels 51 but also through the free spaces 52. The surface area of the free spaces 52 is smaller than the surface area of the channels 51 as seen in plan view.

FIGS. 25A and 25B show another embodiment example of displacement bodies 60, each having a central channel 61 enclosed by a ring-shaped section of displacement body 60. In addition, the displacement body has a semicircular free area 62 on each side and a quadrant-shaped free area 63 on the corner. The displacement bodies 60 can be placed against each other so that the webs 64 lie against each other between the free area 62 and the free area 63, as shown in FIG. 25A.

FIG. 26 shows an embodiment example with four displacement bodies 70 surrounding a channel 71. Channel 71 is surrounded by the four displacement bodies 70. Each displacement body 70 has four outwardly projecting webs 72, wherein two end faces of the adjacent webs 72 rest against each other. The size of the channel 71 is thus determined by the geometry of the webs 72 and the displacement body 70, which in the embodiment example shown is circular in plan view. Other cross-sectional shapes for channel 71 are also possible. The height of the displacement body 70 can be selected according to the strength requirements as in the first embodiment examples.

In the examples shown, the channels are circular or diamond-shaped in cross-section. Other geometries for the channels can also be used.

The displacement bodies 10, 20, 30, 40, 50, 60 can be in loose contact with each other on their contact surface. However, it is also possible to provide connecting elements, such as hooks or other components, which allow the displacement bodies 10, 20, 30, 40, 50, 60 to be fixed together.

FIG. 27 shows another embodiment example of a displacement body 80 composed of two half-shells 80A and 80B. The two half-shells 80A and 80B are connected to each other at a circumferential edge 86, which has a step 87 in the middle area of each side edge. The half-shells 80A and 80B are identical in construction, wherein the upper half-shell is shown in detail in FIGS. 28A and 28B in two views.

The displacement body 80 comprises four hollow bodies 83, which have the shape of a quarter circle segment in plan view. Each hollow body 83 is connected to two adjacent hollow bodies 83 via spacers in the form of webs 84. A marking 85 is provided on each web 84 to assist when the displacement body 80 is to be divided into two parts, for example because one edge of a concrete ceiling no longer provides space for an entire displacement body 80, but can still be filled with half a displacement body 80 with two hollow bodies 83.

Figure 28A:
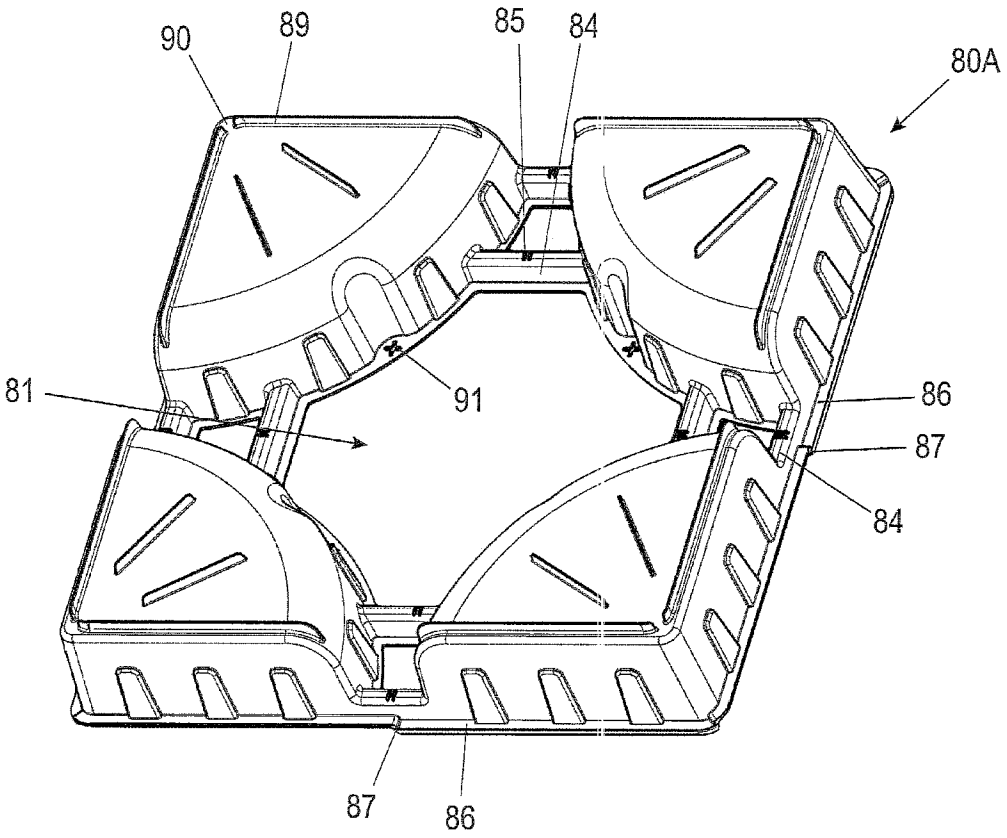
Figure 28B:
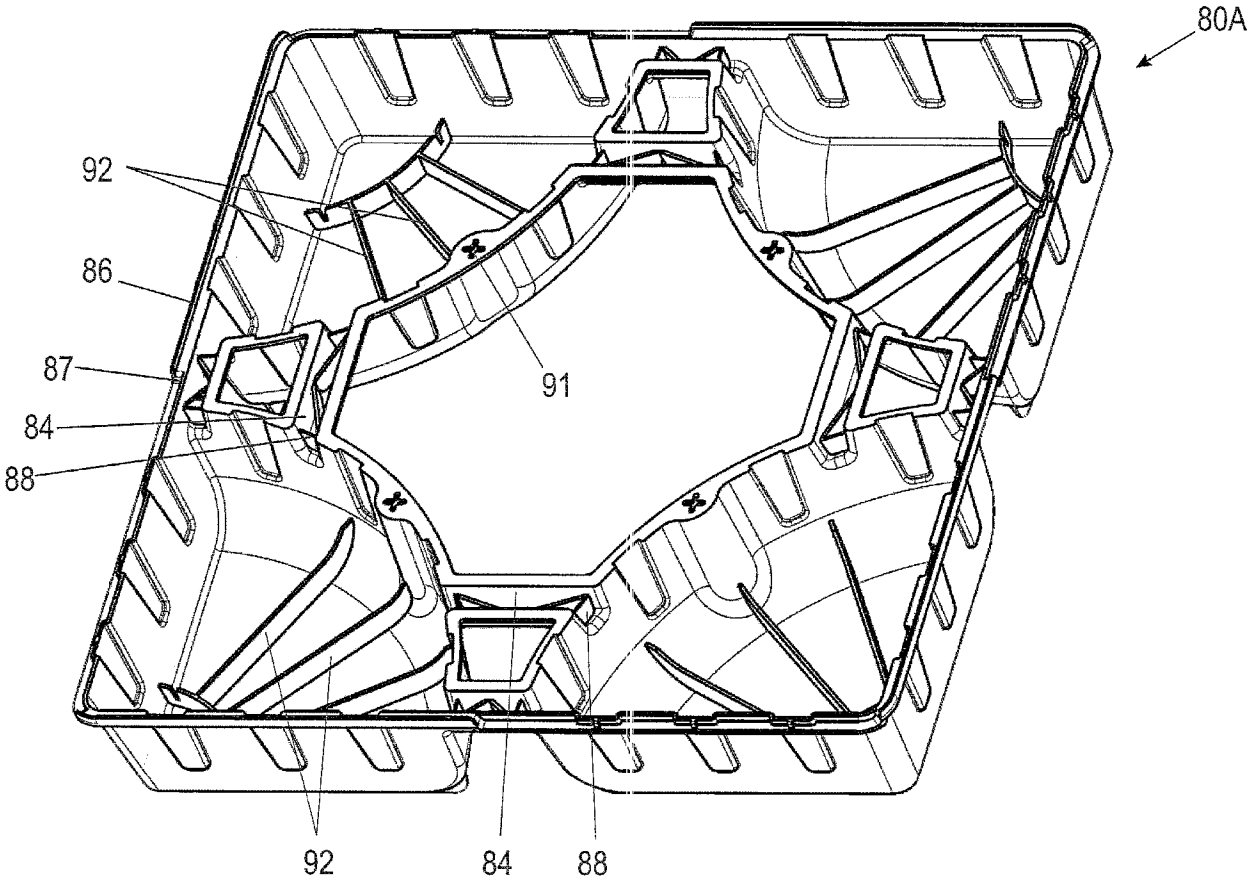

As shown in FIG. 28B, in the area of the webs 84 on the side facing the hollow bodies 83 there are wall sections 88 in the webs 84 so that when the webs 84 are cut through, no or only a small amount of concrete can flow into the hollow bodies 83. Reinforcing ribs 92 are provided on the inside of each hollow body 83, which provide the displacement body 80 with greater dimensional stability.

Figure 29:
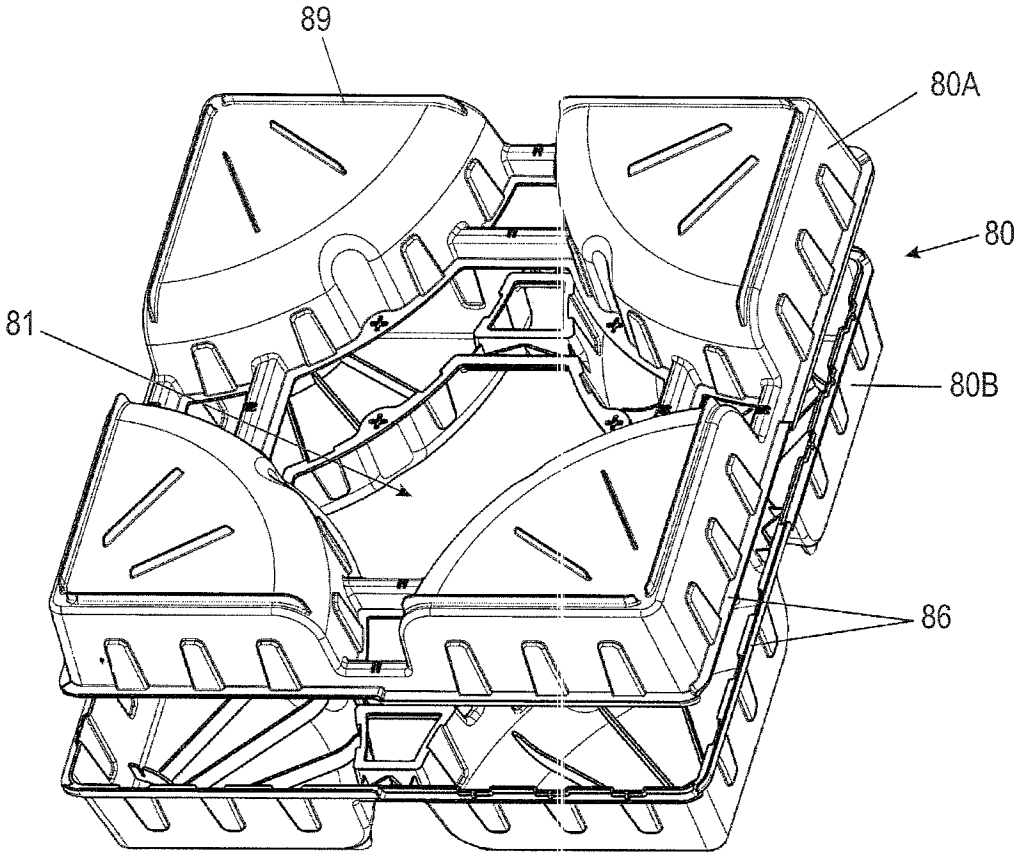
Figure 30:
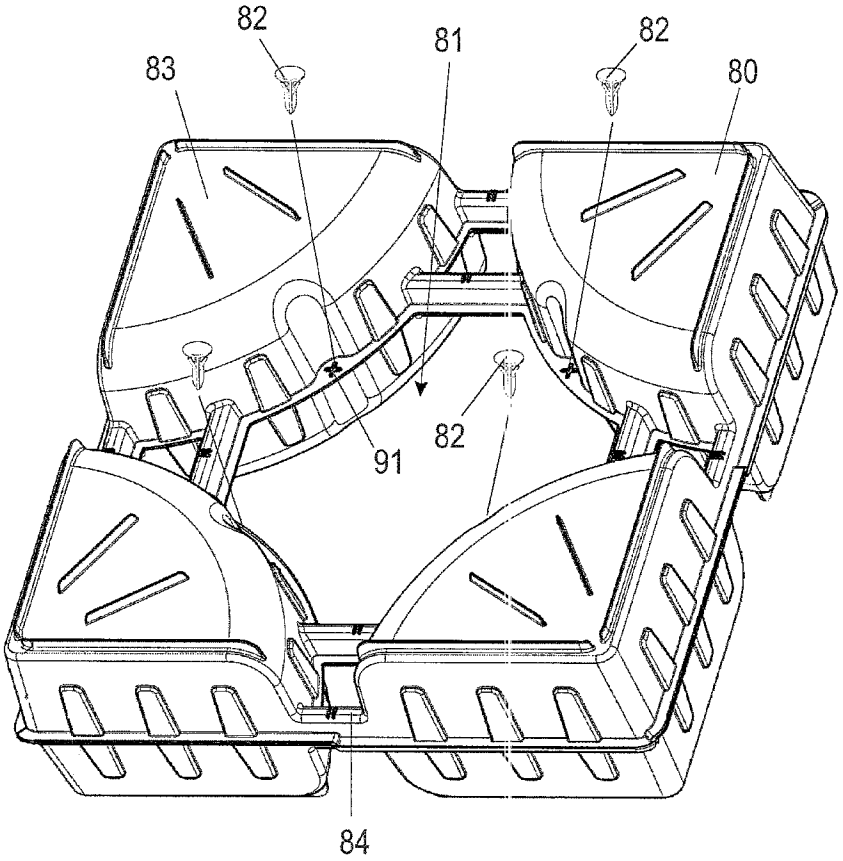

The two half-shells 80A and 80B can be positioned about each other according to FIG. 29 and then placed on top of each other. In this position, optional fixing pins 82 can be inserted into an opening 91 on an edge section to fix the two half-shells 80A and 80B together. The fixing pins 82 penetrate the two edges of the half-shells 80A and 80B so that they can no longer slip relative to each other.

The displacement bodies 80 produced in this way can be placed side by side as shown in FIG. 31, without the need for additional fastening means. Each displacement body 80 in a central region is adjacent to four further displacement bodies 80. A channel 81 is formed between the four hollow bodies 83 of a displacement body 80, which gives the concrete ceiling a defined structure when concrete is poured in.

In FIG. 32, displacement bodies 80 are arranged between a lower reinforcing mesh 5 and an upper reinforcing mesh 2, each comprising longitudinal struts 3 and 6 and transverse struts 4 and 7, as shown in FIG. 33. In this position concrete can now be poured so that a lower concrete layer 9 is provided below the lower reinforcing mesh 5 and an upper concrete layer 8 above the upper reinforcing mesh 2. The concrete flows through channels 81 within displacement body 80.

As an option, it is possible, according to FIG. 34, to provide reinforcement elements 19' for fixing adjacent displacement bodies 80. FIG. 34 shows a reinforcement element 19' in the form of a bracket, which is placed over the adjacent webs 84 to connect the hollow bodies 83.

FIG. 35 shows a bar-shaped reinforcement element 19 which is placed on the displacement body 80, wherein an upwardly projecting angular edge 89 is provided on each hollow body 83, in which a recess 90 is formed in the corner area. The bar-shaped reinforcement element 19 can be inserted into the recess 90 in order to pre-fix the displacement body 80. A bar-shaped reinforcement element 19 can thus extend diagonally over a large number of displacement bodies 80. Optionally, instead of the bar-shaped reinforcement element 19, a reinforcement element according to FIG. 7 with a loop 17 or a waveform can be used.

FIGS. 36A and 36B show the displacement body 80 with the two half-shells 80A and 80B. It is of course possible to make the height of the displacement body 80 and the half-shells larger or smaller and FIG. 37A shows a higher half-shell 80A' of a displacement body 80' formed by two higher half-shells 80A' and 80B'. For even higher ceilings, displacement bodies 80" can also be used according to FIGS. 38A and 38B, which include two even higher half-shells 80A" and 80B". The functionality of the displacement bodies 80' and 80", however, corresponds to the embodiment example of FIGS. 27 to 35.

LIST OF REFERENCE NUMERALS

1 Concrete ceiling
2 Reinforcing mesh
3 Longitudinal strut
4 Transverse strut
5 Reinforcing mesh
6 Longitudinal strut
7 Transverse strut
8 Concrete layer
9 Concrete layer
10 Displacement body
10A Half-shell
10B Half-shell
11 Channel
12 Section
13 Web
14 Edge
15 Recess
16 Reinforcement element
17 Loop
18 Recess
19, 19' Reinforcement element
20 Displacement body
20A Half-shell
20B Half-shell
21 Channel
22 Section
23 Recess
24 Edge
25 Latching web
26 Latching receptacle
27 Retaining web
28 Receptacle
30 Displacement body
30A Half-shell
31 Channel
32 Section
33 Recess
34 Edge
35 Latching web
36 Retaining web
37 Latching receptacle
38 Retaining web
40 Displacement body
40A Half-shell

41 Channel
42 Section
43 Edge section
50 Displacement body
51 Channel
52 Free space
53 Flattened portion
60 Displacement body
61 Channel
62 Free area
63 Free area
64 Web
70 Displacement body
71 Channel
72 Web
80, 80', 80" Displacement body
80A, 80A', 80A" Half-shell
80B, 80B', 80B" Half-shell
81 Channel
82 Fixing pin
83 Hollow bodies
84 Web
85 Marking
86 Edge
87 Step
88 Wall section
89 Edge
90 Recess
91 Opening
92 Reinforcing ribs
h Height
L Width

What is claimed is:

1. A concrete ceiling, comprising:

a lower reinforcing mesh, an upper reinforcing mesh, a plurality of displacement bodies disposed between the lower reinforcing mesh and the upper reinforcing mesh, wherein the lower and upper reinforcing meshes and the displacement bodies are embedded in concrete and each displacement body at least partially surrounds at least one channel which establishes a connection between concrete on the lower reinforcing mesh and concrete on the upper reinforcing mesh, wherein the displacement bodies abut one another on at least three sides at least in sections in a central region of the concrete ceiling, wherein no additional spacers are provided between adjacent displacement bodies, so that the positioning of adjacent displacement bodies takes place by a side edge or a side wall, at which the adjacent displacement bodies contact each other and a ratio of a cross-section of the channel in a displacement body at a narrowest point in the channel to a surface area of the displacement bodies in plan view is at least between 0.2 and 0.45.

2. The concrete ceiling according to claim 1, wherein all sides of the displacement bodies arranged in a central region of the concrete ceiling rest at least in sections against an adjacent one of the displacement bodies.

3. The concrete ceiling according to claim 1, wherein a ratio of a cross-section of the channel in a displacement body at a narrowest point in the channel to the surface area of the displacement bodies in plan view is between 0.3 and 0.4.

4. The concrete ceiling according to claim 1, wherein a diameter of the channel in each of the displacement bodies is between 200 mm and 450 mm.

5. The concrete ceiling according to claim 1, wherein the displacement bodies lie loosely on the lower reinforcing mesh.

6. The concrete ceiling according to claim 1, wherein the displacement bodies are formed substantially square in plan view.

7. The concrete ceiling according to claim 1, wherein free spaces are provided between adjacent displacement bodies, wherein a surface area of the free spaces in plan view is smaller than an area of the channels.

8. The concrete ceiling according to claim 1, wherein at least one of the reinforcing meshes is formed substantially flat and does not engage in a plane of the displacement bodies.

9. The concrete ceiling according to claim 1, wherein each displacement body has a plurality of hollow bodies which are connected to one another via spacers.

10. The concrete ceiling according to claim 9, wherein four hollow bodies are provided which are connected to one another via separable webs.

11. A kit for producing a concrete ceiling according to claim 1, having at least two reinforcing meshes and a plurality of displacement bodies.

12. A method for producing a concrete ceiling, comprising the following steps:

positioning a lower reinforcing mesh;

placing a plurality of displacement bodies on the lower reinforcing mesh, wherein in a central region of the reinforcing mesh the displacement bodies abut one another on at least three sides at least in regions in order to position one another mutually, wherein the displacement bodies are positioned side by side without additional spacers so that the positioning of adjacent displacement bodies is effected by a side edge or a side wall at which the adjacent displacement bodies contact each other, placing an upper reinforcing mesh on the plurality of displacement bodies, and pouring concrete once or several times to produce a concrete ceiling.

13. The method according to claim 12, wherein the displacement bodies abut one another on four sides in a central region of the reinforcing mesh.

* * * * *